US006795660B2

(12) United States Patent
Yugeta et al.

(10) Patent No.: US 6,795,660 B2
(45) Date of Patent: Sep. 21, 2004

(54) DEVELOPER REPLENISHMENT UNIT AND IMAGE FORMATION APPARATUS

(75) Inventors: Satoru Yugeta, Kanagawa (JP); Yoshiyuki Takashima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/367,707

(22) Filed: Feb. 19, 2003

(65) Prior Publication Data

US 2004/0052538 A1 Mar. 18, 2004

(30) Foreign Application Priority Data

Sep. 17, 2002 (JP) ..... P.2002-270384

(51) Int. Cl.[7] ..... G03G 15/08

(52) U.S. Cl. ..... 399/27; 399/28; 399/120; 399/255; 399/258; 399/262

(58) Field of Search ..... 399/27, 28, 120, 399/252, 255, 258, 262, 263

(56) References Cited

U.S. PATENT DOCUMENTS 5,307,129 A * 4/1994 Miura et al. ..... 399/263

* cited by examiner

*Primary Examiner*—Hoang Ngo
(74) *Attorney, Agent, or Firm*—Morgan, Lewis & Bockius LLP

(57) ABSTRACT

An image formation apparatus includes a developing unit for developing latent image, and a reserve tank that temporarily stores developer ejected from a first cartridge and a second cartridge and that discharges the developer to the developing unit. The reserve tank is provided with a storage amount sensor for sensing storage amount of the developer in the first reserve tank. The image formation apparatus further includes a controller for controlling ejection of developer from at least the first cartridge and the second cartridge into the first reserve tank in accordance with output from the storage amount sensor.

15 Claims, 14 Drawing Sheets

M1: DISPENSE MOTOR
M2: CARTRIDGE MOTOR
SN1: TONER SENSOR
TM1: TONER ABSENCE CONTINUATION TIME MEASUREMENT TIMER
TM2: CARTRIDGE MOTOR DRIVE TIME MEASUREMENT TIMER
ta: TONER ABSENCE TIME SUPPLY TIME (0.5 SEC)
tb: REPLENISHMENT TIME (10 SEC)
td: EMPTY CARTRIDGE DETERMINATION TIME PERIOD (25 SEC)

M1: DISPENSE MOTOR
M2: CARTRIDGE MOTOR
SN1: TONER SENSOR
TM1: TONER ABSENCE CONTINUATION TIME MEASUREMENT TIMER
TM2: CARTRIDGE MOTOR DRIVE TIME MEASUREMENT TIMER
TM3: TONER PRESENCE CONTINUATION TIME MEASUREMENT TIMER
ta: TONER ABSENCE TIME SUPPLY TIME (0.5 SEC)
tb: REPLENISHMENT TIME (10 SEC)
td: EMPTY CARTRIDGE DETERMINATION TIME PERIOD

FIG. 13

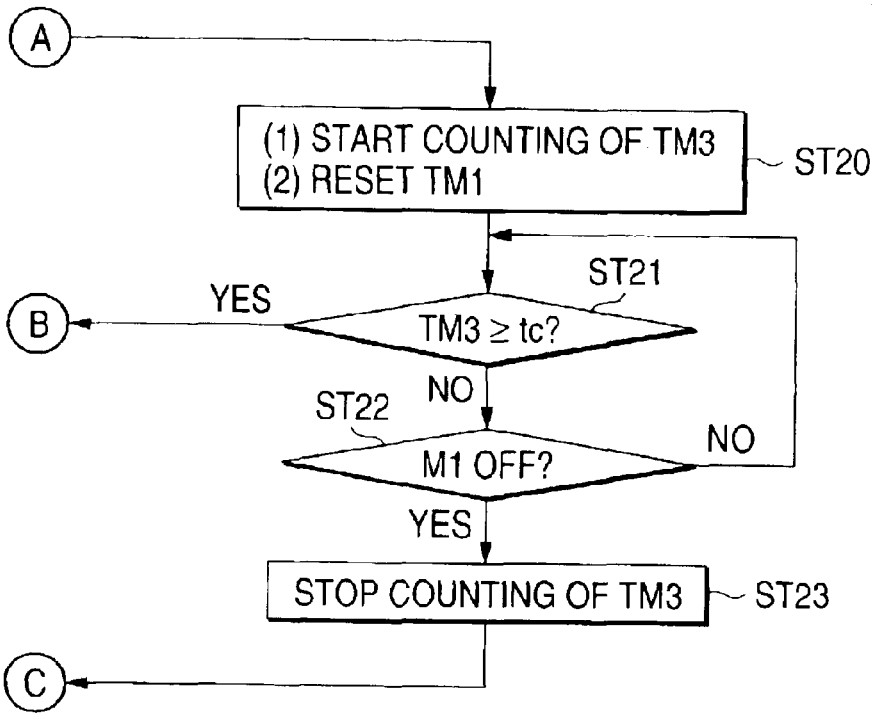

M1: DISPENSE MOTOR
M2: CARTRIDGE MOTOR
SN1: TONER SENSOR
TM1: TONER ABSENCE CONTINUATION TIME MEASUREMENT TIMER
TM2: CARTRIDGE MOTOR DRIVE TIME MEASUREMENT TIMER
TM3: TONER PRESENCE CONTINUATION TIME MEASUREMENT TIMER
ta: TONER ABSENCE TIME SUPPLY TIME (0.5 SEC)
tb: REPLENISHMENT TIME (10 SEC)
tc: TONER PRESENCE TIME SUPPLY TIME (7 SEC)
td: EMPTY CARTRIDGE DETERMINATION TIME PERIOD

DEVELOPER REPLENISHMENT UNIT AND IMAGE FORMATION APPARATUS

BACKGROUND OF THE INVENTION

1. Field of the Invention

This invention relates to a developer replenishment unit for replenishing a developing unit in an image formation apparatus such as an electrophotographic copier or printer with a developer and an image formation apparatus comprising the developer replenishment unit and in particular to a developer replenishment unit for notifying the user of the need for replenishing with toner and controlling prohibiting image formation depending on the remaining amount of toner and an image formation apparatus comprising the developer replenishment unit.

The invention can be used particularly suitably for a developer replenishment unit having a supply vessel (reserve tank) for temporarily storing toner in apart of a supply passage and an image formation apparatus comprising the developer replenishment unit.

2. Background Art

Since an electrophotographic copier, printer, etc., for the user frequently using the copier, printer, etc., consumes a large amount of toner, if a toner cartridge can contain a large amount of toner as much as possible, the number of cartridge replacing times can be lessened and the load on the user can be lightened. However, if one toner cartridge contains a large amount of toner, it is necessary to increase output of a motor for driving a toner transport member in the cartridge and there is a possibility that toner in the cartridge will coagulate. Since the cartridge also becomes large and heavy, the operability when the user replaces the cartridge, etc., worsens. Since a full-color machine needs to use four color toners, limitation on space is large and if only a black toner cartridge frequently used is put into a large capacity, there is a problem of increasing cost, etc.

To solve the problems, the following related arts are known:

Related Art (J01)

In Related art (J01), there provided a plurality of toner cartridges attached to and detached from an image formation apparatus (image formation means) and toner transport tubes being connected to the toner cartridges and merged at midpoint for transporting toner to a developing unit. A sensor for detecting the presence or absence of toner is placed after the toner transport tubes are merged.

In this art, cartridges of all colors can be made common and it is made possible to use a plurality of toner cartridges of only the color frequently used.

Related Art (J02)

In related art (J02), toner supplied from a toner cartridge is once stored in a toner reserve tank and then a developing unit is replenished with the toner.

SUMMARY OF THE INVENTION

Problem of Related Art (J01)

In the related art (J01), when toners in all toner cartridges run out or when only one of cartridges is placed and becomes empty of toner, toner scarcely remains in the toner transport tube and thus there is a problem of need for immediately prohibiting the image formation operation.

Problem of Related Art (J02)

In the related art (J02), the image formation operation can be performed in toner in the toner reserve tank for a while until the toner cartridge is replaced with a new one after the toner cartridge becomes empty of toner. However, there is a problem of increasing cost if a reserve tank and a remaining amount sensor for detecting the remaining amount of toner are provided for each toner cartridge.

It is therefore an object of the invention to provide a developer replenishment unit for replenishing a developing unit with toner and an image formation apparatus comprising the developer replenishment unit for making it possible to:

(O01) detect the presence or absence of toner in all toner cartridges without providing a reserve tank and without providing a remaining amount sensor for each toner cartridge;

(O02) continue image formation without prohibiting the image formation operation immediately when the placed toner cartridge becomes empty of toner; and (O03) reduce the burden on the user at the cartridge replacing time and also decrease the cost without putting a cartridge containing toner frequently used and consumed in a large amount into a large capacity. Next, the invention solving the problems will be discussed. In the description of the invention, the reference numerals in parentheses following the components of the invention are those of the components of an embodiment described later corresponding to the components of the invention. The reason why the invention will be discussed with the components related to the reference numerals of the components of the embodiment described later is that understanding of the invention is facilitated; the scope of the invention is not limited to the embodiment.

To the ends, according to the invention, there is provided a developer replenishment unit comprising the following components (A01) to (A08):

(A01) two contiguous cartridge placement members (4*k* and 6*k*) each in which a developer cartridge (Kk) having a developer replenishment vessel (42*k*) for storing a replenishment developer therein, the developer replenishment vessel having a replenishment port (44*k*) for ejecting the stored developer, and a cartridge transport member (51+52) being supported for rotation in the developer replenishment vessel (42*k*) for ejecting the developer from the replenishment port (44*k*) when the cartridge transport member rotates is placed detachably;

(A02) a reserve tank (H2*k*) having an inflow port (4*bk*, 6*bk*) into which the developers ejected from the replenishment ports (44*k*) of the two developer cartridges (Kk) placed in the two contiguous cartridge placement members (4*k* and 6*k*), the two developer cartridges being named first and second developer cartridges (Kk1 and Kk2), flow, a circulation passage (11+12) for circulating the influent developer, and a supply port (16*k*) for ejecting the developer circulating in the circulation passage (11+12);

(A03) a supply transport member (23*k*) being supported for rotation in the reserve tank (H2*k*) for ejecting the developer in the reserve tank (H2*k*) from the supply port (16*k*) when the supply transport member rotates;

(A04) a developer transport member (1*k*) for transporting the developer ejected from the supply port (16*k*) to a developing unit (Gk) for developing an electrostatic latent image formed on an image support (PRk) surface to a toner image;

(A05) a cartridge drive (MB2*k*) having a first cartridge drive (MB2*k*1) and a second cartridge drive (MB2*k*2)

for separately rotating the cartridge transport members (51+52) of the first cartridge (Kk1) and the second cartridge (Kk2);

(A06) a supply drive (MB1*k*) for rotating the supply transport member (23*k*) in the reserve tank (H2*k*);

(A07) a storage amount sensor (SN1*k*) for sensing whether or not the storage amount of the developer in the reserve tank (H2*k*) is a predetermined amount or more; and (A08) cartridge control means (C5) for controlling operation of the cartridge drive (MB2*k*) so that the detection value of the storage amount sensor (SN1*k*) indicates presence.

In the developer replenishment unit of the invention, the number of the developer cartridges (Kk) is not limited to two and may be three or more (namely, at least two) That is, it is also possible to place three or more developer cartridges (Kk) in the three or more contiguous cartridge placement members (4*k*, 6*k*).

In the developer replenishment unit of the invention comprising the components (A01) to (A08), the cartridge transport member (51+52) of the developer cartridge (Kk) ejects the replenishment developer stored in the developer replenishment vessel (42*k*) from the replenishment port (44*k*) when the cartridge transport member rotates. The cartridge transport member (51+52) of the first cartridge (Kk1) and the second cartridge (Kk2) placed in the two contiguous cartridge placement members (4*k* and 6*k*) are rotated separately by the cartridge drive (MB2*k*) having the first cartridge drive (MB2*k*1) and the second cartridge drive (MB2*k*2). The developer ejected from each replenishment port (44*k*) of the first cartridge (Kk1) and the second cartridge (Kk2) flows through the inflow port (4*bk*, 6*bk*) into the reserve tank (H2*k*).

The developer flowing into the reserve tank (H2*k*) circulates in the circulation passage (11+12) in the reserve tank (H2*k*). The developer circulating in the circulation passage (11+12) is ejected from the supply port (16*k*) by the supply transport member (23*k*) supported for rotation in the reserve tank (H2*k*). The developer ejected from the supply port (16*k*) is transported by the developer transport member (1*k*) to the developing unit (Gk) for developing the electrostatic latent image formed on the image support (PRk) surface to a toner image. The one storage amount sensor (SN1*k*) placed in the reserve tank (H2*k*) senses whether or not the storage amount of the developer in the reserve tank (H2*k*) is a predetermined amount or more. The cartridge control means (C5) controls operation of the cartridge drive (MB2*k*) for making the developer flow into the reserve tank (H2*k*) so that the detection value of the storage amount sensor (SN1*k*) indicates presence.

Therefore, in the developer replenishment unit of the invention, one storage amount sensor (SN1*k*) detects the amount of the developer in the reserve tank (H2*k*) into which developers flow from the two developer cartridges (Kk), so that it is not necessary to place a sensor for each developer cartridge. That is, if two (a plurality of) developer cartridges (Kk) of frequently used color are used, the number of sensors for detecting the presence or absence of developer can be decreased and therefore the cost can be reduced.

Two (a plurality of) developer cartridges (Kk) containing color toner frequently used and consumed in a large amount are placed and when both the developer cartridges (Kk) become empty of developer, they are replaced at a time, whereby the number of developer cartridge (Kk) replacement times can be decreased and the burden on the user can be reduced. Further, since two (a plurality of) developer cartridges (Kk) are placed, it becomes unnecessary to put the developer cartridge (Kk) into a large capacity. Therefore, the need for handling a large and heavy developer cartridge (Kk) put into a large capacity is eliminated and the burden on the user at the cartridge replacing time can be reduced. Since the developer cartridge (Kk) is not put into a large capacity, the load on the motor can be decreased and a high-output motor need not be used, so that an increase in cost can be prevented. Further, since it is not necessary to put the developer cartridge (Kk) into a large capacity, all developer cartridges (Ky, Km, Kc, and Kk) can be formed as similar shapes and the components can be made common; the cost can be reduced.

The developer replenishment unit of the invention comprises the reserve tank (H2*k*) and thus if the developer in the placed developer cartridge (Kk) runs out, it is not necessary to immediately prohibit the image formation operation and the image formation operation can be continued using the developer stored in the reserve tank (H2*k*) for a while.

The developer replenishment unit of the invention comprising the components can also comprise the following components (A09) and (A010):

(A09) an empty state notification unit (UI1) for notifying the user that when either the first cartridge (Kk1) or the second cartridge (Kk2) is used, the cartridge being used becomes empty; and (A10) empty state notification unit control means (C8) for operating the empty state notification unit (UI1) if it is made impossible for the detection value of the storage amount sensor (SN1*k*) to indicate presence when either the first cartridge (Kk1) or the second cartridge (Kk2) is used.

In the developer replenishment unit comprising the components (A09) and (A010), the empty state notification unit control means (C8) operates the empty state notification unit (UI1) if it is made impossible for the detection value of the storage amount sensor (SN1*k*) to indicate presence when either the first cartridge (Kk1) or the second cartridge (Kk2) is used. The empty state notification unit (UI1) notifies the user that when either the first cartridge (Kk1) or the second cartridge (Kk2) is used, the cartridge being used becomes empty.

Therefore, in the developer replenishment unit of the invention, if the developer cartridge (Kk) cannot immediately be replaced because there is no spare on hand, etc., the image formation operation is not prohibited and can be continued using the developer in the other developer cartridge (Kk) or the developer in the reserve tank (H2*k*).

The developer replenishment unit of the invention comprising the components can also comprise the following components (A011) and (A012):

(A011) consumption amount detection means (C3) for detecting the consumption amount of the developer of the developing unit (Gk); and (A012) supply control means (C4) for controlling operation of the supply drive (MB1*k*) so as to eject the developer from the supply port (16*k*) in response to the consumption amount detected by the consumption amount detection means (C3).

In the developer replenishment unit of the invention comprising the components, the consumption amount detection means (C3) detects the consumption amount of the developer consumed in the developing unit (Gk). The supply control means (C4) controls operation of the supply drive (MB1*k*) so as to eject the developer from the supply port (16*k*) in response to the consumption amount detected by the consumption amount detection means (C3). Therefore, the developer is supplied from the reserve tank (H2*k*) in response to the amount of the developer consumed in the image formation operation. The reserve tank (H2*k*) is replenished with the developer from the developer cartridge (Kk) in response to the detection result of the storage amount sensor (SN1*k*) of the reserve tank (H2*k*). Consequently, the storage amount of the developer in the reserve tank (H2*k*) is held almost constant, and the developer supply rate (dispense rate) from the reserve tank (H2*k*) to the developing unit (Gk) is also held almost constant.

The developer replenishment unit of the invention comprising the components can also comprise the following components (A013) to (A017):

(A013) the inflow port (4*bk*, 6*bk*) having a first inflow port (4*bk*) and a second inflow port (6*bk*) into which the developers ejected from the replenishment ports (44*k*) of the first cartridge (Kk1) and the second cartridge (Kk2) flow separately;

(A014) the second inflow port (6*bk*) and the first inflow port (4*bk*) being placed in order as they are from the storage amount sensor (SN1*k*) to the upstream side of the circulation passage (11+12) in the reserve tank (H2*k*);

(A015) the first cartridge drive (MB2*k*1) for operating the cartridge transport member (51+52) of the first cartridge (Kk1) only for a setup replenishment time (tb) for replenishing the reserve tank (H2*k*) with the developer in the first cartridge (Kk1) each time the supply time of the operation time of the supply drive (MB1*k*) reaches a setup value (ta, tc) while the first cartridge (Kk1) is used;

(A016) supply time setup value storage means (C6) for storing the setup value (ta, tc) of the supply time while the first cartridge (Kk1) is used; and (A017) replenishment time setup value storage means (C7) for storing the setup value (tb) of the replenishment time while the first cartridge (Kk1) is used.

In the developer replenishment unit of the invention comprising the components (A013) to (A017), the developer ejected from the first cartridge (Kk1) flows into the first inflow port (4*bk*) and the developer ejected from the second cartridge (Kk2) flows into the second inflow port (6*bk*) separate from the first cartridge (Kk1) The second inflow port (6*bk*) and the first inflow port (4*bk*) are placed in order as they are from the storage amount sensor (SN1*k*) to the upstream side of the circulation passage (11+12) in the reserve tank (H2*k*). The first cartridge drive (MB2*k*1) operates the cartridge transport member (51+52) of the first cartridge (Kk1) only for the setup replenishment time (tb) for replenishing the reserve tank (H2*k*) with the developer in the first cartridge (Kk1) each time the supply time of the operation time of the supply drive (MB1*k*) reaches the setup value (ta, tc) while the first cartridge (Kk1) is used.

Therefore, in the first cartridge (Kk1) for allowing the developer to flow in from the first inflow port (4*bk*) upstream apart from the storage amount sensor (SN1*k*), the cartridge transport member (51+52) operates every setup supply time (ta, tc) and the developer is ejected. Since it takes time until the developer flowing in from the first inflow port (4*bk*) is transported to the location where the storage amount sensor (SN1*k*) is placed, if the developer is replenished, the detection value of the storage amount sensor (SN1*k*) does not indicate presence and the developer may be over replenished or when the detection value of the storage amount sensor (SN1*k*) indicates presence, the storage amount of the developer in the reserve tank (H2*k*) may over lessen.

However, in the developer replenishment unit of the invention, for example, the setup value (ta, tc) of the supply time is not only set so as to operate the cartridge transport member (51+52) if the storage amount sensor (SN1*k*) detects developer absence, but also set so as to operate the cartridge transport member (51+52) while the storage amount sensor (SN1*k*) detects developer presence, whereby the storage amount in the reserve tank (H2*k*) can be adjusted. Therefore, in the developer replenishment unit of the invention, if developers flow in from the two separate inflow ports of the first inflow port (4*bk*) and the second inflow port (6*bk*), the storage amount of the developer in the reserve tank (H2*k*) can be maintained in a predetermined range using the one storage amount sensor (SN1*k*) and the dispense rate can be held a predetermined value.

To the ends, according to the invention, there is provided an image formation apparatus comprising a developer replenishment unit (Hk) comprising the components described above.

Since the image formation apparatus of the invention comprising the components comprises the developer replenishment unit (Hk) comprising the components, the developer storage amount in the reserve tank (H2*k*) into which developers flow from the two developer cartridges (Kk) can be adjusted based on the detection value of the one storage amount sensor (SN1*k*). If two (a plurality of) developer cartridges of frequently used color (Kk) are used, it becomes unnecessary to provide the storage amount sensor (SN1*k*) for detecting the presence or absence of developer for each developer cartridge and therefore the cost can be reduced.

Two (a plurality of) developer cartridges (Kk) containing color toner frequently used and consumed in a large amount are placed and when all the developer cartridges (Kk) become empty of developer, they are replaced at a time, whereby the number of developer cartridge (Kk) replacement times can be decreased and the burden on the user can be reduced. Since it becomes unnecessary to put the developer cartridge (Kk) into a large capacity, the burden on the user at the cartridge replacing time as the cartridge becomes heavy and large can be lightened. Since the developer cartridge (Kk) is not put into a large capacity, the load on the motor can be decreased and a high-output motor need not be used, so that an increase in cost can be prevented. Further, all color developer cartridges (Ky, Km, Kc, and Kk) are formed as similar shapes, whereby the parts can be made common, and the cost can be reduced.

The developer replenishment unit of the invention comprises the reserve tank (H2*k*) and thus if the developer in the used developer cartridge (Kk) runs out, the image formation operation is not immediately prohibited and can be continued using the developer in the reserve tank (H2*k*) for a while.

To the ends, according to the invention, there is provided an image formation apparatus comprising the following components (B01) to (B09):

(B01) Y (yellow), M (magenta), C (cyan), and K (black) color toner image formation units (Uy, Um, Uc, and Uk) each comprising a rotating image support (PRy, PRm, PRc, PRk) with a surface passing through a charging area, a latent image formation position (Q1*y*, Q1*m*, Q1*c*, Q1*k*), a developing area (Q2*y*, Q2*m*, Q2*c*, Q2*k*), a primary transfer area (Q3*y*, Q3*m*, Q3*c*, Q3*k*), and a cleaning area in order, a charger (CRy, CRm, CRc, CRk) for uniformly charging the image support (PRy, PRm, PRc, PRk) surface in the charging area, a latent image formation unit (ROS) for forming an electrostatic latent image on the charged image support (PRy, PRm, PRc, PRk) surface at the latent image formation position (Q1*y*, Q1*m*, Q1*c*, Q1*k*), a developing unit (Gy, Gm, Gc, Gk) for developing the electrostatic latent image to a toner image in the developing area (Q2*y*, Q2*m*, Q2*c*, Q2*k*), and a cleaner (CLy, CLm, CLc, CLk) for collecting in the cleaning area the remaining toner on the image support (PRy, PRm, PRc, PRk) surface with the toner image primary-transferred to an intermediate transfer belt (B) when the image support surface passes through the primary transfer area (Q3*y*, Q3*m*, Q3*c*, Q3*k*);

(B02) the Y (yellow), M (magenta), C (cyan), and K (black) color developing units (Gy, Gm, Gc, Gk) each having a developer vessel for storing a developer containing Y (yellow), M (magenta), C (cyan), K (black) color toner and a developing roll being supported on the developer vessel for rotation for transporting the developer deposited on a surface of the developing roll to the developing area (Q2*y*, Q2*m*, Q2*c*, Q2*k*) opposed to the image support (PRy, PRm, PRc, PRk) and developing the electrostatic latent image formed on the image support surface to a toner image;

(B03) a belt module (BM) having the intermediate transfer belt (B) for passing through the primary transfer areas (Q3*y*, Q3*m*, Q3*c*, Q3*k*) in order for coming in contact with the image support (PRy, PRm, PRc, PRk) surfaces of the Y (yellow), M (magenta), C (cyan), and K (black) color toner image formation units (Uy, Um, Uc, and Uk) in order to which the toner images on the image support (PRy, PRm, PRc, PRk) surfaces are transferred in order in an overlap manner, a plurality of belt support rolls (Rt, Rw, Rf, and T2*a*) including a belt drive roll (T2*a*) and a plurality of driven rolls (Rt, Rw, and Rf) for supporting the intermediate transfer belt (B), a primary transfer device (T1*y*, T1*m*, T1*c*, T1*k*) for transferring the toner images on the image support (PRy, PRm, PRc, PRk) surfaces to the belt (B) surface in the primary transfer area (Q3*y*, Q3*m*, Q3*c*, Q3*k*), and a belt frame for supporting the intermediate transfer belt (B), the belt support rolls (Rt, Rw, Rf, and T2*a*), and the primary transfer device (T1*y*, T1*m*, T1*c*, T1*k*);

(B04) a secondary transfer device (T2) for secondary-transferring the toner images primary-transferred in order onto the intermediate transfer belt (B) onto a record sheet (S);

(B05) a fuser (F) for fixing the toner images secondary-transferred onto the record sheet (S);

(B06) Y (yellow), M (magenta), C (cyan), and K (black) color cartridge placement members (4*k*, 6*y*, 6*m*, 6*c*, and 6*k*) in which Y (yellow), M (magenta), C (cyan), and K (black) color developer cartridges (Ky, Km, Kc, and Kk) having developer replenishment vessels (42*y*, 42*m*, 42*c*, and 42*k*) for storing replenishment Y (yellow), M (magenta), C (cyan), and K (black) color developers therein, each of the developer replenishment vessels having a replenishment port (44*y*, 44*m*, 44*c*, 44*k*) for ejecting the stored developer, and cartridge transport members (51+52) being supported for rotation in the developer replenishment vessels (42*y*, 42*m*, 42*c*, and 42*k*) for ejecting the developers from the replenishment ports (44*y*, 44*m*, 44*c*, and 44*k*) when the cartridge transport members rotate are placed detachably;

(B07) a reserve tank (H2*k*) for K (black) color, having an inflow port (4*bk*, 6*bk*) into which the developers ejected from the replenishment ports (44*k* and 44*k*) of the K (black) color cartridges placed contiguous to each other, the K (black) color cartridges being named first and second cartridges (Kk1 and Kk2), flow, a circulation passage (11+12) for circulating the influent developer, and a supply port (16*k*) for ejecting the developer circulating in the circulation passage (11+12);

(B08) a supply transport member (23*k*) being supported for rotation in the reserve tank (H2*k*) for ejecting the developer in the reserve tank (H2*k*) from the supply port (16*k*) when the supply transport member rotates; and (B09) a K (black) color developer transport member (1*k*) for transporting the K (black) color developer ejected from the supply port (16*k*) to a developing vessel of the K (black) color developing unit (Gk).

The image formation apparatus of the invention comprising the components (B01) to (B09) is a full-color tandem image formation apparatus. The Y (yellow), M (magenta), C (cyan), and K (black) color toner image formation units (Uy, Um, Uc, and Uk) comprise the rotating image supports (PRy, PRm, PRc, and PRk), the chargers (CRy, CRm, CRc, and CRk), the latent image formation units (ROS), the developing units (Gy, Gm, Gc, and Gk), and the cleaners (CLy, CLm, CLc, and CLk). The Y (yellow), M (magenta), C (cyan), and K (black) color developer cartridges (Ky, Km, Kc, and Kk) are placed detachably in the Y (yellow), M (magenta), C (cyan), and K (black) color cartridge placement members (4*k*, 6*y*, 6*m*, 6*c*, and 6*k*). In the Y (yellow), M (magenta), C (cyan), and K (black) color developer cartridges (Ky, Km, Kc, and Kk), when the cartridge transport members (51+52) in the developer replenishment vessels (42*y*, 42*m*, 42*c*, and 42*k*) rotate, the developers stored in the developer replenishment vessels (42*y*, 42*m*, 42*c*, and 42*k*) are ejected from the replenishment ports (44*y*, 44*m*, 44*c*, and 44*k*). The developers ejected from the replenishment ports (44*k* and 44*k*) of the first and second cartridges (Kk1 and Kk2) flow into the reserve tank (H2*k*) for K (black) color through the inflow ports (4*bk* and 6*bk*). The influent developer circulates in the circulation passage (11+12). The supply transport member (23*k*) ejects the developer circulating in the reserve tank (H2*k*) from the supply port (16*k*). The K (black) color developer transport member (1*k*) transports the K (black) color developer ejected from the supply port (16*k*) to the developing vessel of the K (black) color developing unit (Gk). To replenish each developing units (Gc, Gm, Gk) with developer from the Y (yellow), M (magenta), C (cyan) developer cartridges (Ky, Km, Kc) other than K (black), it is also possible to supply the developer through the reserve tanks (H2*y*, H2*m*, H2*c*) as with K (black) or it is also possible to supply the developer directly by a transport member, etc., without providing the reserve tanks (H2*y*, H2*m*, H2*c*).

Therefore, two (a plurality of) developer cartridges (Kk) of K (black) frequently used are placed in the image formation apparatus of the invention, so that the K developer amount is large, the number of developer cartridge (Kk) replacement times can be decreased, and the burden on the user can be lightened. Since two (a plurality of) developer cartridges (Kk) are placed, it becomes unnecessary to put the developer cartridge (Kk) into a large capacity. Therefore, the need for handling a large and heavy developer cartridge (Kk) put into a large capacity is eliminated and the burden on the user at the cartridge replacing time can be reduced. Further, since it is not necessary to put the developer cartridge (Kk) into a large capacity, all developer cartridges (Ky, Km, Kc, and Kk) can be formed as similar shapes and the components can be made common; the cost can be reduced.

The reserve tank (H2*k*) is provided and thus if the developer in the placed developer cartridge (Kk) runs out, the image formation operation is not immediately prohibited and can be continued using the developer in the reserve tank (H2*k*) for a while.

The image formation apparatus of the invention comprising the components can further comprise the following components (B010) to (B013):

(B010) a K (black) color cartridge drive (MB2*k*) having a first cartridge drive (MB2*k*1) and a second cartridge drive (MB2*k*2) for separately rotating the cartridge transport members (51+52) of the first cartridge (Kk1) and the second cartridge (Kk2);

(B011) a supply drive (MB1*k*) for rotating the supply transport member (23*k*) in the K (black) color reserve tank (H2*k*);

(B012) a storage amount sensor (SN1*k*) for sensing whether or not the storage amount of the developer in the K (black) color reserve tank (H2*k*) is a predetermined amount or more; and (B013) cartridge control means (C5) for controlling operation of the K (black) color cartridge drive (MB2*k*) so that the detection value of the storage amount sensor (SN1*k*) indicates presence.

In the image formation apparatus of the invention comprising the components (B010) to (B013), the cartridge transport members (51+52) of the first cartridge (Kk1) and the second cartridge (Kk2) are separately rotated by the K (black) color cartridge drive (MB2*k*) and the second cartridge drive (MB2*k*2). The one storage amount sensor (SN1*k*) senses whether or not the storage amount of the developer in the K (black) color reserve tank (H2*k*) is a predetermined amount or more. The cartridge control means (C5) controls operation of the K (black) color cartridge drive (MB2*k*) so that the detection value of the storage amount sensor (SN1*k*) indicates presence for supplying the developer from the developer cartridge (Kk) being used to the developing unit (Gk).

Therefore, in the image formation apparatus of the invention, the one storage amount sensor (SN1*k*) detects the developer amount in the reserve tank (H2*k*) into which developers flow from the two developer cartridges (Kk1 and Kk2), so that it is not necessary to provide the sensor for each developer cartridge. That is, the number of the sensors for detecting the presence or absence of developer can be decreased and therefore the cost can be reduced.

BRIEF DESCRIPTION OF THE DRAWINGS

The present invention may be more readily described with reference to the accompanying drawings:

FIG. 13 is a flowchart continued from the flowchart of FIG. 12; and

DETAILED DESCRIPTION OF THE PREFERRED EMBODIMENTS

Figure 1:
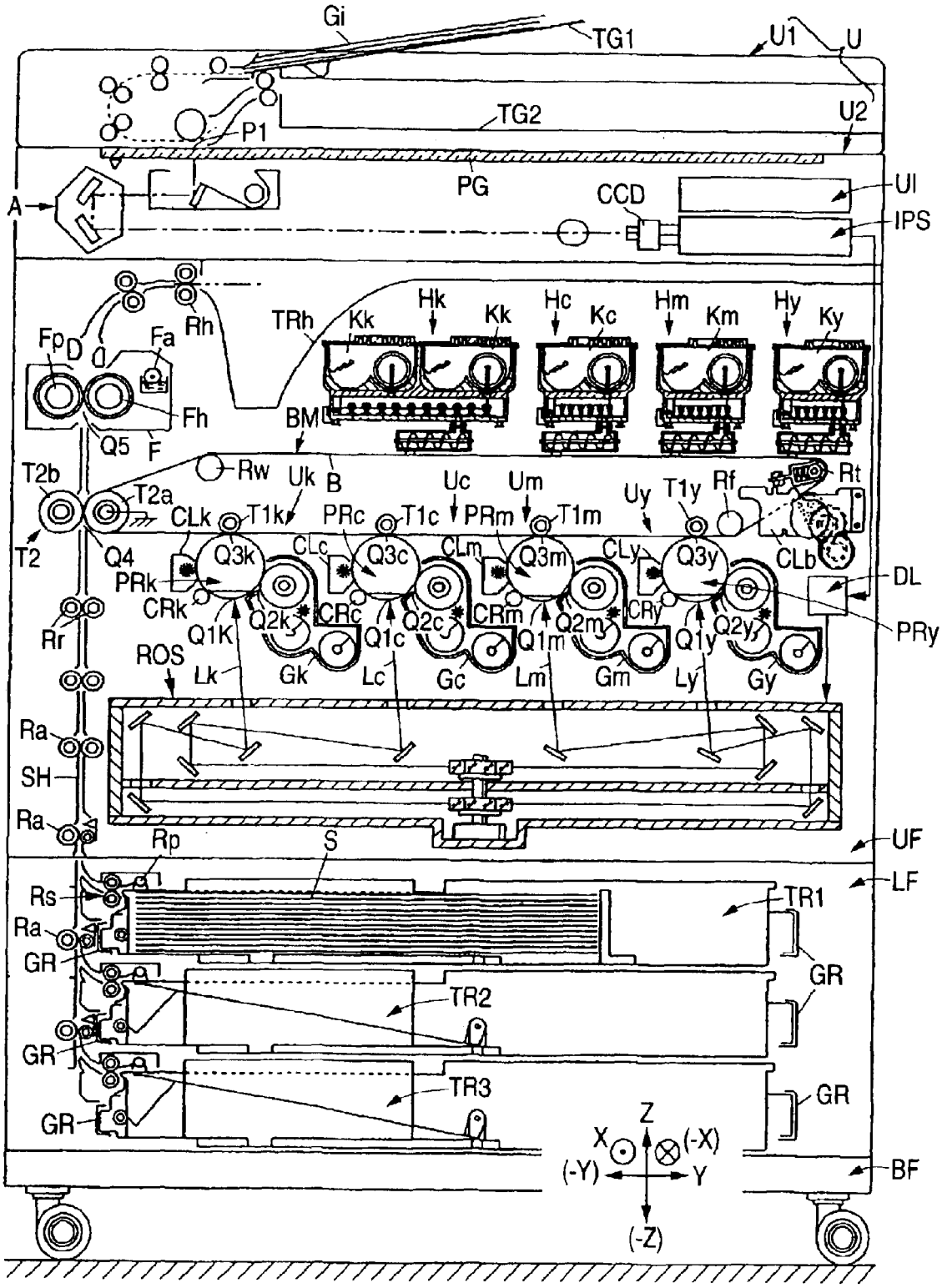
FIG. 1 is a schematic representation of an image formation apparatus comprising developer replenishment units of a first embodiment of the invention.

Referring now to the accompanying drawings, there are shown preferred embodiments of the invention. However, the invention is not limited to the following embodiments.

For easy understanding of the description to follow, in the accompanying drawings, back and forth direction is X axis direction, side to side direction is Y axis direction, and up and down direction is Z axis direction, and directions or sides indicated by arrows X, −X, Y, −Y, Z, and −Z are forward, backward, rightward, leftward, upward, and downward or front, rear (back), right, left, upper side (top), and lower side (bottom).

In the accompanying drawings, a mark comprising a dot described in a circle means an arrow from the back of the plane of the drawing to the surface and a mark comprising X described in a circle means an arrow from the surface of the plane of the drawing to the back.

First Embodiment

FIG. 1 is a schematic representation of an image formation apparatus comprising developer replenishment units of a first embodiment of the invention.

In FIG. 1, an image formation apparatus U comprises an automatic original transport unit U1 and an image formation apparatus main unit (copier) U2 supporting the automatic original transport unit and having platen glass PG on the top of the main unit.

The automatic original transport unit U1 has an original feed tray TG1 on which a plurality of originals Gi to be copied are stacked and an original ejection tray TG2 to which the original Gi transported from the original feed tray TG1 through a copy position (original read position) P1 on the platen glass PG is ejected.

The image formation apparatus main unit U2 has a U1 (user interface) for the user to enter an operation command signal of copy start, etc., a light exposure optical system A, and the like.

Reflected light from the original transported by the automatic original transport unit U1 to the original read position P1 on the platen glass PG or an original (not shown) manually placed on the platen glass PG is converted into electric signals of R (red), G (green), and B (blue) by CCD (charge-coupled device) through the light exposure optical system A.

An IPS (image processing system) converts the RGB electric signals input from the CCD into image data of K (black), Y (yellow), M (magenta), and C (cyan), temporarily stores the image data, and outputs the image data to a laser drive circuit DL at a predetermined timing as image data for forming a latent image.

If the original image is monochrome, the image data of only K (black) is input to the laser drive circuit DL.

The laser drive circuit DL has Y, M, C, and K laser drive circuits (not shown) and outputs laser drive signals responsive to the input image data to color latent image write laser diodes (not shown) of a latent image formation optical system (electrostatic latent image formation unit) ROS at a predetermined timing.

Toner image formation units Uy, Um, Uc, and Uk placed above the ROS are units for forming color toner images of Y (yellow), M (magenta), C (cyan), and K (black).

Y, M, C, and K laser beams Ly, Lm, Lc, and Lk emitted from the laser diodes (not shown) of the latent image formation optical system ROS are incident on rotating photoconductors (image supports) PRy, PRm, PRc, and PRk.

The Y toner image formation unit Uy has the rotating photoconductor PRy, a charging roll CRy as a charger, a transfer roll (transfer device) T1*y*, and a cleaner CLy; each of the toner image formation units Um, Uc, and Uk is configured like the Y toner image formation unit Uy.

The photoconductors PRy, PRm, PRc, and PRk are uniformly charged by the charging rolls CRy, CRm, CRc, and CRk and then electrostatic latent images are formed on the surfaces of the photoconductors PRy, PRm, PRc, and PRk by applying the laser beams Ly, Lm, Lc, and Lk at image write positions (latent image formation positions) Q1*y*, Q1*m*, Q1*c*, and Q1*k*. The electrostatic latent images on the surfaces of the photoconductors PRy, PRm, PRc, and PRk are developed into toner images by the developing units Gy, Gm, Gc, and Gk in developing areas Q2*y*, Q2*m*, Q2*c*, and Q2*k*.

The provided toner images are transported to primary transfer areas Q3*y*, Q3*m*, Q3*c*, and Q3*k* for coming in contact with an intermediate transfer belt (transfer member; intermediate transfer body; image support) B. Primary transfer voltage of the opposite polarity to the toner charge polarity is applied at a predetermined timing from a power supply circuit E controlled by a controller C to primary transfer rolls T1*y*, T1*m*, T1*c*, and T1*k* placed on the back of the intermediate transfer belt B in the primary transfer areas Q3*y*, Q3*m*, Q3*c*, and Q3*k*.

The toner images on the photoconductors PRy, PRm, PRc, and PRk are primary-transferred to the intermediate transfer belt B by the primary transfer rolls T1*y*, T1*m*, T1*c*, and T1*k*. The remaining toners on the surfaces of the photoconductors PRy, PRm, PRc, and PRk after the primary transfer are cleaned by photoconductor cleaners CLy, CLm, CLc, and CLk.

A belt module BM that can be moved up and down and can be drawn out to the front is placed above the photoconductors PRy, PRm, PRc, and PRk. The belt module BM has the intermediate transfer belt B, belt support rolls (Rt, Rw, Rf, T2*a*) including a tension roll Rt, a walking roll Rw, an idler roll (free roll) Rf, and a backup roll T2*a* also serving as a drive roll, the primary transfer rolls T1*y*, T1*m*, T1*c*, and T1*k*, and a belt cleaner (intermediate transfer body cleaner) CLb. The intermediate transfer belt B is supported by the belt support rolls (Rt, Rw, Rf, T2*a*) for rotation and move.

A secondary transfer roll T2*b* is opposed to the surface of the intermediate transfer belt B in contact with the backup roll T2*a*, and the rolls T2*a* and T2*b* make up a secondary transfer device T2. A secondary transfer area Q4 is formed in an area wherein the secondary transfer roll T2*b* and the intermediate transfer belt B are opposed to each other.

Color toner image overlapped and transferred in order onto the intermediate transfer belt B by the transfer devices T1*y*, T1*m*, T1*c*, and T1*k* in the primary transfer areas Q3*y*, Q3*m*, Q3*c*, and Q3*k* is transported to the secondary transfer area Q4.

Three pairs of left and right guide rails GR and GR for supporting paper feed trays TR1 to TR3 so that the paper feed trays TR1 to TR3 can be drawn out and inserted in the back and forth direction (X axis direction) are provided below the ROS. Record sheets (transfer members) S on each of the paper feed trays TR1 to TR3 are taken out by a pickup roll Rp and are separated one by one by a separation roll Rs and then sent to registration rolls Rr by a plurality of transport rolls Ra. The plurality of sheet transport rolls Ra are placed along a sheet transport passage SH formed by a sheet guide, and the registration rolls Rr are placed upstream in the sheet transport direction from the secondary transfer area Q4. The sheet transport passage SH, the sheet transport rolls Ra, the registration rolls Rr, and the like make up a sheet transport unit (SH+Ra+Rr).

The registration rolls Rr transport the record sheet S to the secondary transfer area Q4 at the timing at which the color toner image formed on the intermediate transfer belt B is transported to the secondary transfer area Q4. When the record sheet S passes through the secondary transfer area Q4, the backup roll T2*a* is grounded and secondary transfer voltage of the opposite polarity to the toner charge polarity is applied at a predetermined timing from the power supply circuit E controlled by the controller C to the second transfer roll T2*b*. At this time, the color toner image on the intermediate transfer belt B is transferred to the record sheet S by the secondary transfer device T2.

The intermediate transfer belt B after the secondary transfer is cleaned by the belt cleaner CLb.

The record sheet S to which the toner image is secondary-transferred is transported to a fixing area Q5 of a press area of a heating roll Fh and a pressurizing roll Fp of a fuser F and when the record sheet S passes through the fixing area Q5, it is heated and fixed and then is ejected from an ejection roller Rh to a paper ejection tray TRh.

A release agent for providing good releasability of the record sheet S from the heating roll Fh is applied onto the surface of the heating roll Fh by a release agent application unit Fa.

In FIG. 1, the image formation apparatus U has an upper frame UF and a lower frame LF, and the ROS and the members placed above the ROS (the photoconductors PRy, PRm, PRc, and PRk, the developing units Gy, Gm, Gc, and Gk, the belt module BM, etc.,) are supported on the upper frame UF.

The guide rails GR for supporting the paper feed trays TR1 to TR3 and the paper feed members (the pickup roll Rp, the separation roll Rs, the sheet transport roll Ra, etc.,) for feeding paper from each paper feed tray TR1 to TR3 are supported on the lower frame LF.

Developer Replenishment Unit

Figure 2:
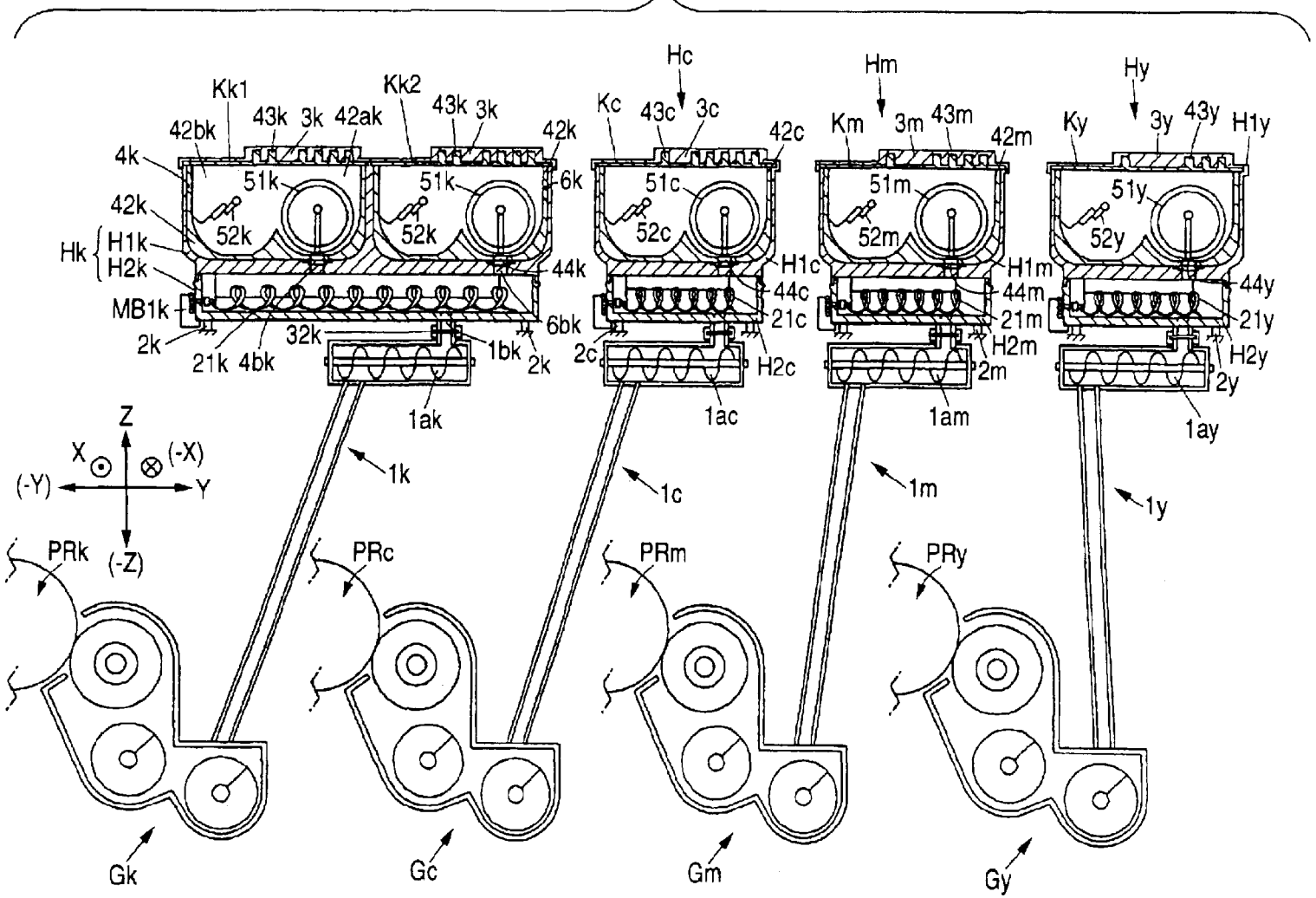
FIG. 2 is a cross-sectional schematic representation of the main parts of the developer replenishment units of the first embodiment of the invention.

FIG. 2 is a cross-sectional schematic representation of the main parts of the developer replenishment units of the first embodiment of the invention.

Figure 3:
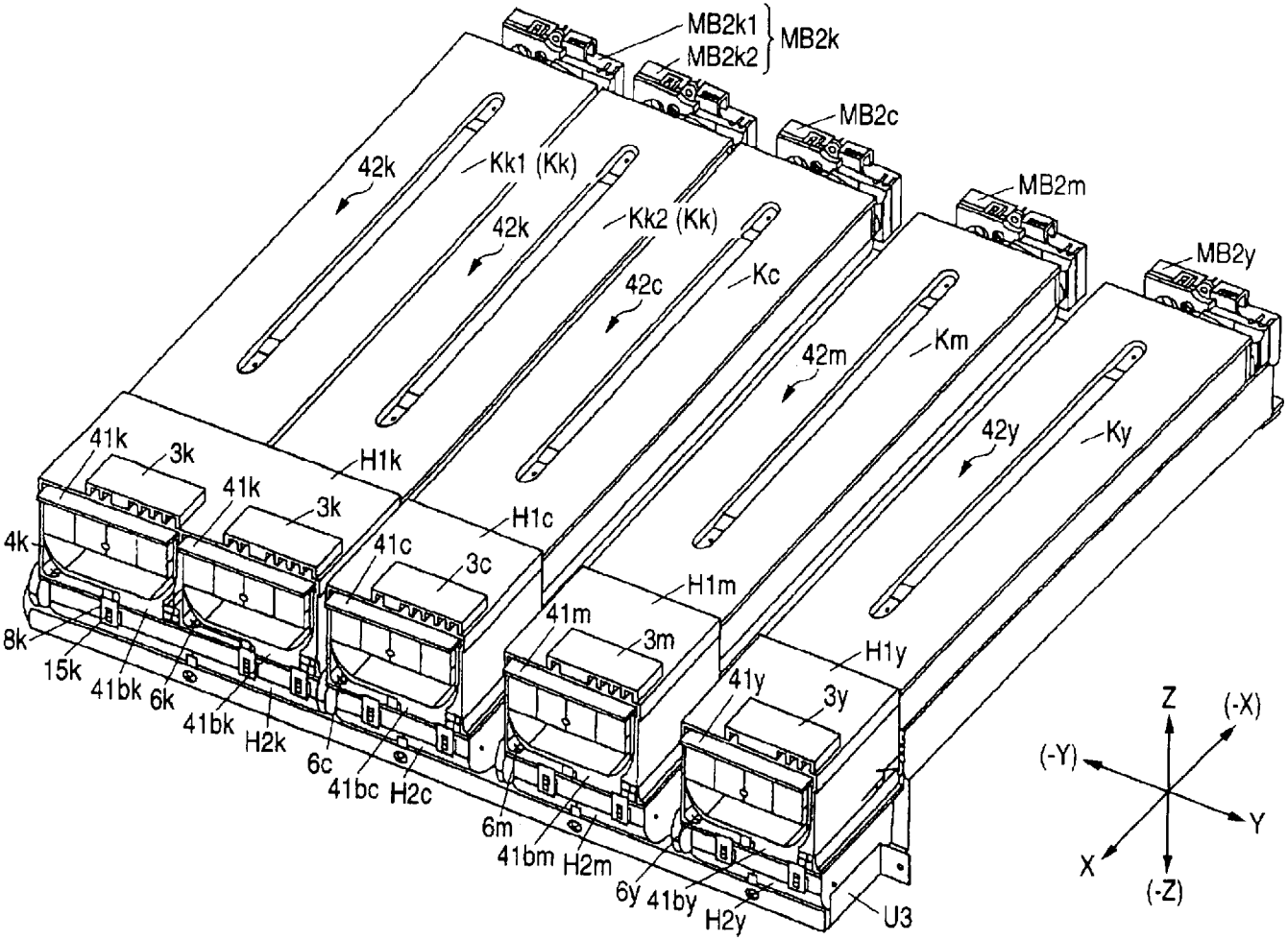
FIG. 3 is a perspective view of the developer replenishment units of the first embodiment of the invention.

FIG. 3 is a perspective view of the developer replenishment units of the first embodiment of the invention.

In FIG. 1, developer replenishment units Hy, Hm, Hc, and Hk in which toner cartridges (developer cartridges) Ky, Km, Kc, and Kk for storing Y (yellow), M (magenta), C (cyan), and K (black) toners (developers) are placed are disposed above the belt module BM. In FIG. 2, the developer replenishment units Hy, Hm, Hc, and Hk are joined to the developing units Gy, Gm, Gc, and Gk through toner supply members (developer transport members) 1*y*, 1*m*, 1*c*, and 1*k* containing transport augers 1*ay*, 1*am*, 1*ac*, and 1*ak*, and toners ejected from the developer replenishment units Hy, Hm, Hc, and Hk are supplied to the developing units Gy, Gm, Gc, and Gk by the toner supply members 1*y*, 1*m*, 1*c*, and 1*k*.

In FIGS. 2 and 3, the developer replenishment units Hy, Hm, Hc, and Hk have cartridge support members H1*y*, H1*m*, H1*c*, and H1*k* in which the toner cartridges Ky, Km, Kc, and Kk are detachably placed and reserve tanks H2*y*, H2*m*, H2*c*, and H2*k* fitted into the lower parts of the cartridge support members H1*y*, H1*m*, H1*c*, and H1*k*. The developer replenishment units Hy, Hm, Hc, and Hk are positioned and supported on a replenishment unit support frame U3 (see FIG. 3) of the image formation apparatus main unit U2 by a plurality of supporting legs 2*y*, 2*m*, 2*c*, and 2*k* (see FIG. 2) placed on the bottoms of the reserve tanks H2*y*, H2*m*, H2*c*, and H2*k*.

In FIGS. 2 and 3, in the cartridge support members H1*y*, H1*m*, H1*c*, and H1*k*, only the cartridge support member H1*k* of K (black) frequently used allows two toner cartridges Kk1 and Kk2 to be attached thereto and detached therefrom, and other cartridge support members H1*y*, H1*m*, and H1*c* allow one toner cartridge Ky, Km, and Kc to be attached thereto and detached therefrom respectively. For the toner cartridges Ky, Km, Kc, Kk1, and Kk2, erroneous placement prevention parts 3*y*, 3*m*, 3*c*, 3*k*, and 3*k* are formed integrally on the tops of the cartridge support members H1*y*, H1*m*, H1*c*, and H1*k*. The Y (yellow) erroneous placement prevention part 3*y* has one erroneous placement prevention hole piercing in the back and forth direction on the left (−Y side) and three erroneous placement prevention holes on the right (+Y side), and the M (magenta) erroneous placement prevention part 3*m* has one erroneous placement prevention hole on the left and four erroneous placement prevention holes on the right. The C (cyan) erroneous placement prevention part 3*c* has one erroneous placement prevention hole on the left and four erroneous placement prevention holes on the right, and the black (K) erroneous placement prevention part 3*k* has two erroneous placement prevention holes on the left and four erroneous placement prevention holes on the right. The number and placement of the erroneous placement prevention holes can be changed arbitrarily.

Figure 4:
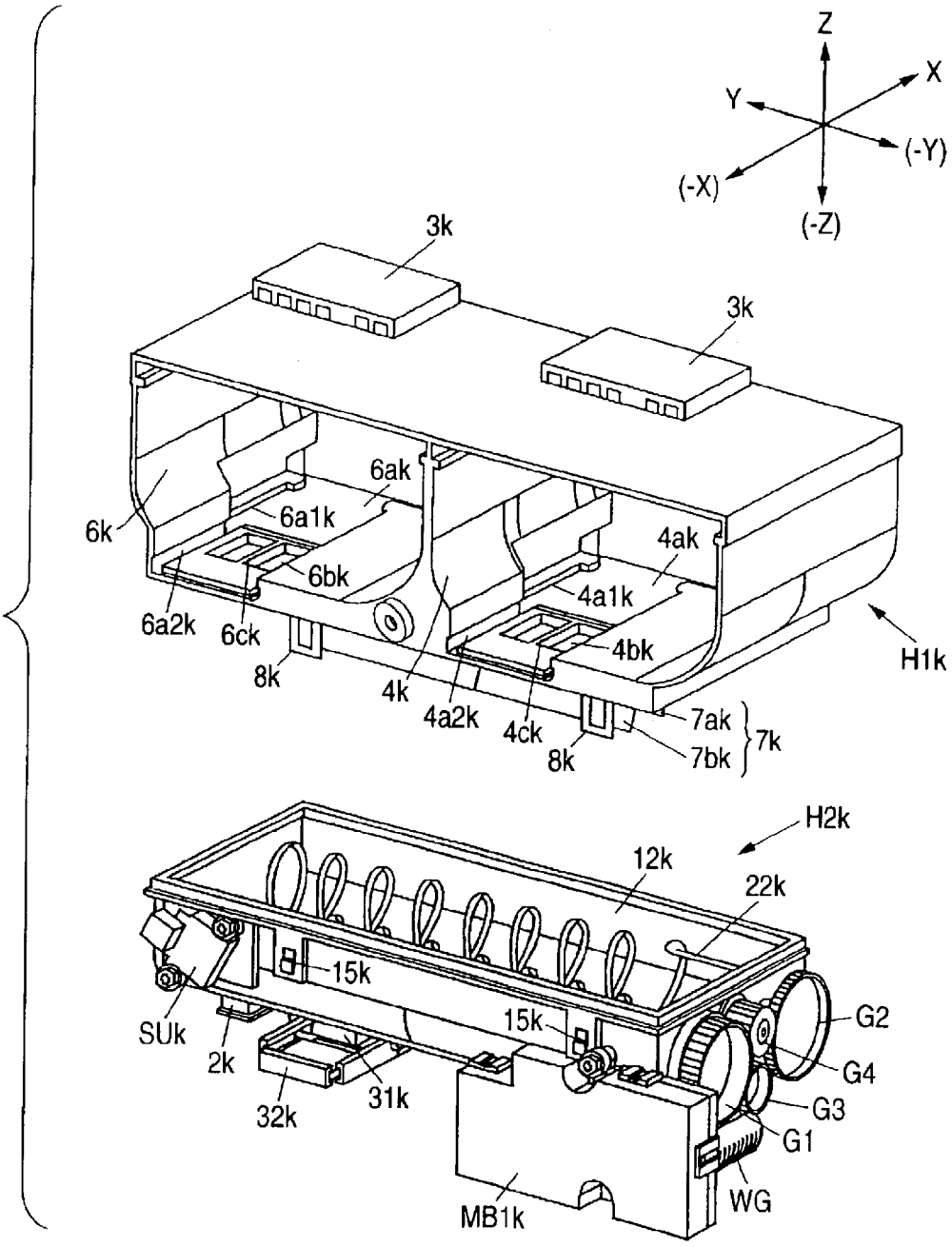
FIG. 4 is an exploded perspective view of K (black) developer replenishment unit of the developer replenishment units of the first embodiment of the invention.

FIG. 4 is an exploded perspective view of the K (black) developer replenishment unit Hk of the developer replenishment units of the first embodiment of the invention.

Figure 5:
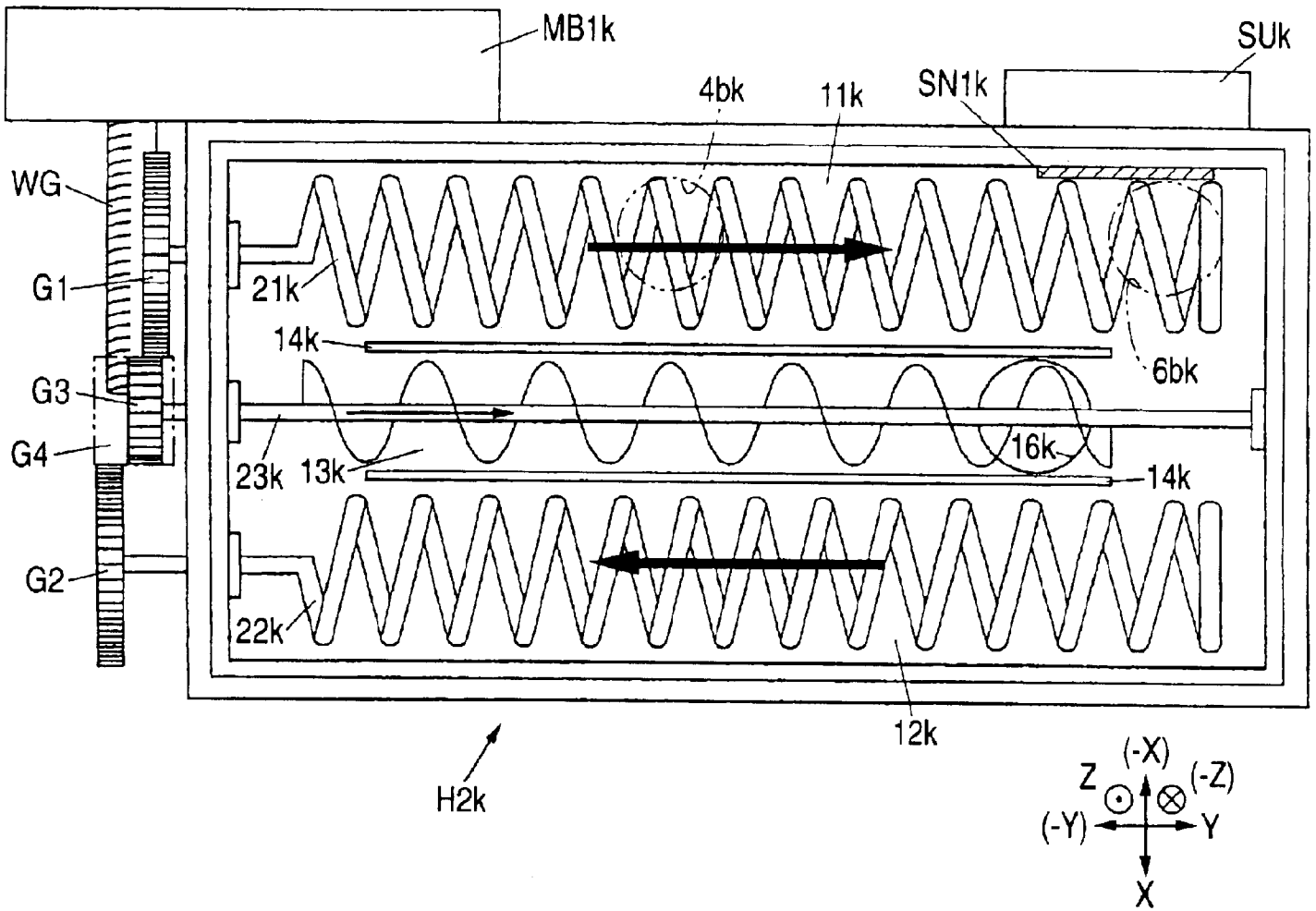
FIG. 5 is a plan view of a reserve tank of the K (black) developer replenishment unit.

FIG. 5 is a plan view of the reserve tank of the K (black) developer replenishment unit Hk.

In FIG. 4, the cartridge support member H1*k* of the K (black) developer replenishment unit Hk has a first cartridge placement hole (cartridge placement member) 4*k* on the left (−Y side) through which the toner cartridge Kk pierces for placement, and a second cartridge placement hole (cartridge placement member) 6*k* on the right (+Y side). The toner cartridge Kk placed in the first cartridge placement hole 4*k* is named first cartridge Kk1 and the toner cartridge Kk placed in the second cartridge placement hole 6*k* is named second cartridge Kk2. The cartridge placement holes 4*k* and 6*k* are formed on bottom walls with replenishment port guide grooves 4*ak* and 6*ak*. The replenishment port guide groove 4*ak*, 6*ak* has a wide part 4*a*1*k*, 6*a*1*k* at the front (+X side) and a narrow part 4*a*2*k*, 6*a*2*k* at the rear (−X side). The narrow parts 4*a*2*k* and 6*a*2*k* are formed with a first inflow port 4*bk* and a second inflow port 6*bk* piercing up and down.

A guide lib 6*ck* is formed at the center of the second inflow port 6*bk*. The guide lib 6*ck* operates in conjunction with agitator (21*k*, 22*k*) described later and guides a sensor cleaner (not shown) for cleaning a toner sensor (SN1*k*) described later. A lib 4*ck* is also formed at the center of the first inflow port 4*bk* to make equal the toner inflow amount supplied through the second inflow port 6*bk* from the second cartridge Kk2 and the toner inflow amount supplied through the first inflow port 4*bk* from the first cartridge Kk1.

The peripheral surface portion of a semi-cylindrical reserve tank partition wall 7*k* is supported on the lower face of the cartridge support member H1*k* and has a front lower end part 7*ak* and a rear lower end part 7*bk*. A pair of left and right engagement members 8*k* and 8*k* is supported at both ends at the front and back (X axis direction) of the lower part of the cartridge support member H1*k*.

In FIG. 5, the K reserve tank H2*k* has a first circulation passage 11*k* at the rear (−X side), a second circulation passage 12*k* at the front (+X side), and a supply passage 13*k* at the center. Partition walls 14*k* and 14*k* projecting upward are formed between the circulation passage 11*k* and the supply passage 13*k* and between the circulation passage 12*k* and the supply passage 13*k*. When the reserve tank H2*k* is fitted into the cartridge support member H1*k* in one piece, the partition walls 14*k* and 14*k* engage the front lower end part 7*ak* and the rear lower end part 7*bk* of the reserve tank partition wall 7*k* (see FIG. 4) of the cartridge support member H1*k*, and the supply passage 13*k* is partitioned from the circulation passages 11*k* and 12*k*.

When the reserve tank H2*k* is fitted into the cartridge support member H1*k*, the engagement members 8*k* and 8*k* of the cartridge support member H1*k* and a pair of left and right engagement projection parts 15*k* and 15*k* (see FIG. 4) provided on both outer walls at the front and back of the reserve tank H2*k* engage each other, so that the cartridge support member H1*k* is firmly fixed to the reserve tank H2*k*.

The first circulation passage 11*k* and the second circulation passage 12*k* make up a circulation passage (11+12).

A supply port 16*k* for ejecting a developer (see FIG. 5) is formed at the right (+Y side part) of the supply passage 13*k*. A sensor unit SUk (see FIGS. 4 and 5) is supported in the right part of the rear end wall of the reserve tank H2*k* (−X end wall +Y side portion). The sensor unit SUk has the toner sensor (storage amount sensor, remaining amount sensor) SN1*k* placed in the side wall portion of the right end part (+Y end part, most downstream part) of the first circulation passage 11*k*. The toner sensor SN1*k* detects the presence or absence of toner in the proximity, thereby detecting the storage amount of toner in the reserve tank H2*k*.

In FIG. 5, the first agitator 21*k* shaped like a spiral (a spring) for transporting toner in the first circulation passage 11*k* from the left to the right (in the arrow direction in FIG. 5) at the rotating time is placed in the first circulation passage 11*k*, and the second agitator 22*k* shaped like a spring for transporting toner from the right to the left at the rotating time is placed in the second circulation passage 12*k*. The left end part (−Y end part) of each agitator 21*k*, 22*k* is supported on the left end wall of the reserve tank H2*k* via a bearing for rotation. The left end (−Y end) of each agitator 21*k*, 22*k* projects to the outside of the reserve tank H2*k* and a first gear G1 and a second gear G2 are fixedly secured to an outer end. When the first agitator 21*k* transports toner, since the agitator is shaped like a spiral, the toner height does not become constant and toner may be transported leaning to the front or back of the first circulation passage 11*k*. If toner is transported leaning to the front (+X side), there is a possibility that it will be made impossible to detect toner by the toner sensor SN1*k* placed on the rear end wall (−X side wall). Therefore, the first agitator 21*k* of the first embodiment is made spiral so that toner is transported leaning to the toner sensor SN1*k* placement side (rear end wall side).

A supply auger (supply transport member) 23*k* for transporting tone circulating in the circulation passage (11+12) of the reserve tank H2*k* to the inside of the supply passage 13*k* and transporting toner in the supply passage 13*k* to the supply port 16*k* is placed in the supply passage 13*k*. Both left and right end parts of the supply auger 23*k* are supported on the reserve tank H2*k* via a bearing for rotation. The left end (−Y end) of the supply auger 23*k* projects to the outside of the reserve tank H2*k* and a supply gear G3 meshing the first gear G1 is fixedly secured to the tip of the supply auger 23*k*.

In FIG. 4, a rotation force transmission gear G4 meshing the first gear G1 and the second gear G2 is supported on the left end outer wall of the reserve tank H2*k*. A dispense motor box (supply drive) MB1*k* consisting of a dispense motor (M1*k* (not shown)), a reduction gear, and a worm gear WG is supported in a rear left part (−X side −Y side portion) of the reserve tank H2*k*. Rotation of the dispense motor is reduced by the reduction gear and is transmitted to the worm gear WG and is transmitted to the supply gear G3 meshing the worm gear WG. Therefore, rotation of the dispense motor is transmitted in the order of the worm gear WG, the supply gear G3, the first gear G1, the rotation force transmission gear G4, and the second gear G2 for rotating the agitators 21*k* and 22*k* and the supply auger 23*k*.

In FIGS. 2 and 4, a supply port joint part 31*k* (see FIG. 4) communicating with the supply port 16*k* and joined to the toner supply member 1*k* (see FIG. 2) is supported on the lower face of the reserve tank H2*k*. A shutter 32*k* open in the normal mode, when the developer replenishment unit Hk is detached from the image formation apparatus U because of a failure, etc., the shutter 32*k* for closing the lower end part of the supply port joint part 31*k* is supported at the lower end of the supply port joint part 31*k*.

The configuration of the K (black) developer replenishment unit Hk has been described with reference numerals and symbols ending with k. Other developer replenishment units Hy, Hm, and Hc differ from the developer replenishment unit Hk only in the following three points (1) to (3) and therefore will not be discussed in detail:

(1) Two toner cartridges Kk and Kk can be attached to and detached from the K (black) developer replenishment unit Hk and one toner cartridge Ky, Km, Kc can be attached to and detached from the developer replenishment unit Hy, Hm, Hc;

(2) accompanying the difference in (1), the first cartridge placement hole 4*k*, the first inflow port 4*bk*, and the like are not provided; and (3) accompanying the difference in (1), the side-to-side (Y axis direction) length of the reserve tank H2*y*, H2*m*, H2*c*, the agitator 21*y*, 21*m*, 21*c*, 22*y*, 22*m*, 22*c*, the transport auger 23*y*, 23*m*, 23*c*, etc., is shorter than that of K.

Figure 6:
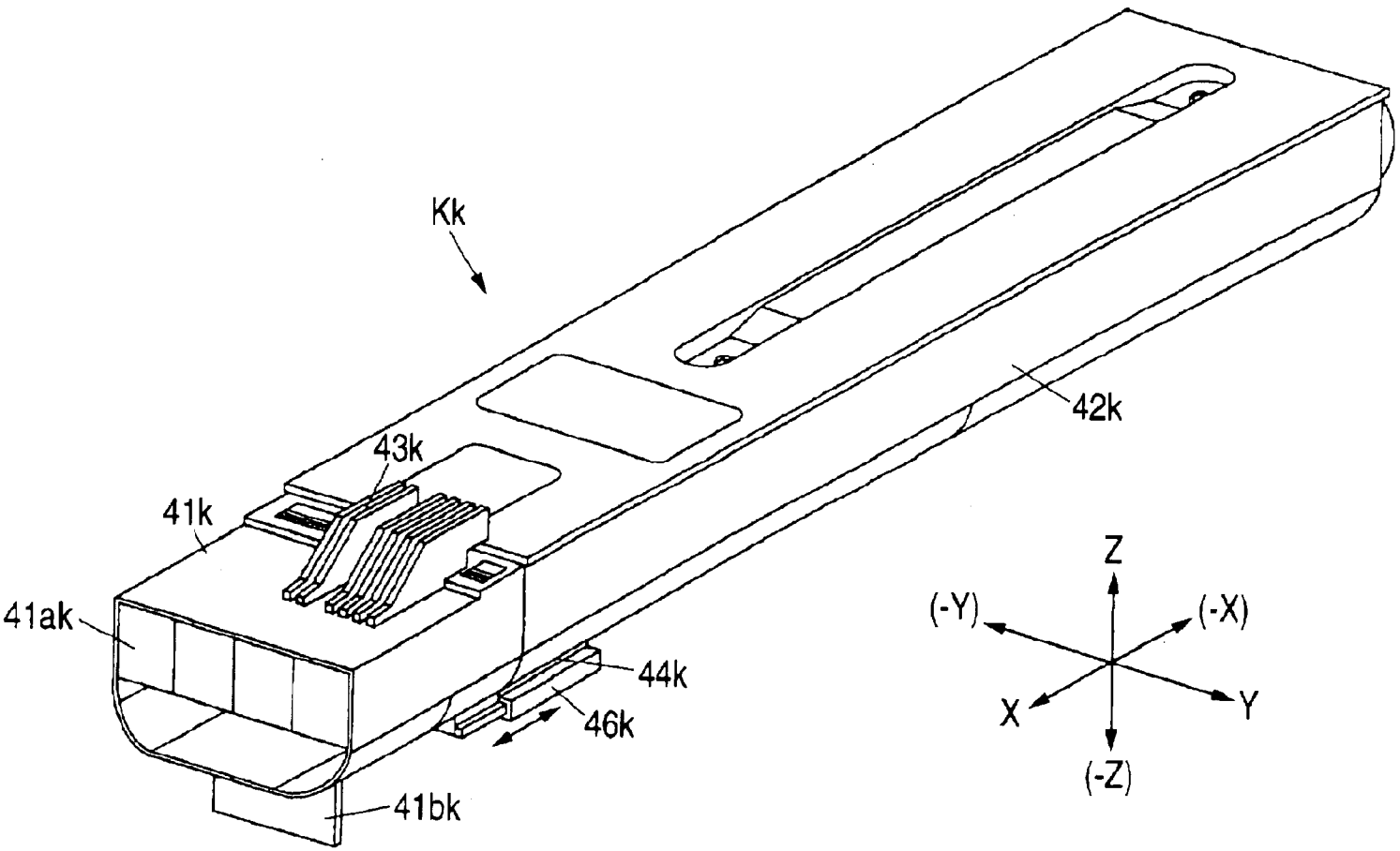
FIG. 6 is a perspective view of a K toner cartridge placed in the developer replenishment unit.

FIG. 6 is a perspective view of the K toner cartridge placed in the developer replenishment unit.

The Y, M, C, and K toner cartridges Ky, Km, Kc, and Kk are configured in a similar fashion and therefore only the K toner cartridge will be discussed in detail with reference numerals ending with k and other toner cartridges Ky, Km, and Kc will not be discussed in detail.

In FIG. 6, the K toner cartridge Kk has a supported member 41*k* at the front (+X side) supported by the cartridge support member H1*k* when the K toner cartridge Kk is placed in the cartridge placement hole 4*k*, 6*k* and a toner storage vessel (developer replenishment vessel) 42*k* at the rear (−X side) for storing replenishment toner therein. The supported member 41*k* has a knob part 41*ak* for the user to hold the toner cartridge Kk with his or her hand when the user handles the toner cartridge Kk, and a stopper part 41*bk*, when the toner cartridge Kk pierces the cartridge support member H1*k* and is placed, for abutting the front end face of the cartridge support member H1*k* and preventing the user from excessively inserting the toner cartridge Kk.

Erroneous placement prevention projection parts 43*k* are provided on the top face of the supported member 41*k*. The erroneous placement prevention projection parts 43*k* are formed corresponding to the number and placement of the erroneous placement prevention holes 3*k*; two projection parts on the left (−Y side) and four projection parts on the right (+Y side) are provided. Y (yellow), M (magenta), C (cyan) erroneous placement prevention projection parts 43*y*, 43*m*, 43*c* are also formed corresponding to the number and placement of the erroneous placement prevention holes 3*y*, 3*m*, 3*c* (see FIG. 2). Therefore, only if the erroneous placement prevention projection parts 43*y*, 43*m*, 43*c*, 43*k* match the erroneous placement prevention part 3*y*, 3*m*, 3*c*, 3*k*, namely, only if the toner color in the toner cartridge Ky, Km, Kc, Kk matches the toner color of the developing unit Gy, Gm, Gc, Gk replenished with toner by the developer replenishment unit Hy, Hm, Hc, Hk, the toner cartridge Ky, Km, Kc, Kk can be placed and a different-color toner cartridge is prevented from being erroneously placed in the developer replenishment unit.

In FIGS. 2, 3, and 6, the toner storage vessel 42*k* is formed inside with a first storage part 42*ak* on the right (+Y side) (see FIG. 2) and a second storage part 42*bk* on the left. The first storage part 42*ak* is formed at the front end part with a replenishment port 44*k* for ejecting toner (see FIGS. 2 and 6). A replenishment port shutter 46*k* is supported slidably in the back and forth direction on the replenishment port 44*k*. The replenishment port shutter 46*k* is formed of a plate-like member of the same width as the wide part 4*a*1*k*, 6*a*1*k* (see FIG. 4) of the replenishment port guide groove 4*ak*, 6*ak* of the cartridge support member H1*k*. Therefore, when the toner cartridge Kk is inserted into the cartridge support member H1*k*, the replenishment port shutter 46*k* engages the wide part 4*a*1*k*, 6*a*1*k* of the replenishment port guide groove 4*ak*, 6*ak* and cannot enter the narrow part 4*a*2*k*, 6*a*2*k*. That is, when the toner cartridge Kk is inserted to the end and is placed, the replenishment port shutter 46*k* is pressed by the front end of the narrow part 4*a*2*k*, 6*a*2*k* and is slid relatively to the replenishment port 44*k*. At this time, the replenishment port 44*k* of the toner cartridge Kk is opened and communicates with the inflow port 4*bk*, 6*bk*.

A cartridge agitator 51*k* shaped like a spiral for transporting stored toner to the replenishment port 44*k* for ejection is placed in the first storage part 42*ak*. A rotation transport member 52*k* for transporting toner in the second storage part 42*bk* to the first storage part 42*ak* is placed in the second storage part 42*bk*. The cartridge agitator 51*k* and the rotation transport member 52*k* are supported on the front and back end walls (±X end walls) of the toner cartridge Kk via bearings for rotation. A coupling (not shown) is fixedly secured to each of the rear ends (−X ends) of the cartridge agitator 51*k* and the rotation transport member 52*k*.

In FIG. 3, the couplings of the cartridge agitator 51*k* and the rotation transport member 52*k* engage coupling of a cartridge motor box (cartridge drive) MB2*k* placed in the image formation apparatus main unit U2 when the toner cartridge Kk is placed. Unlike the Y, M, and C toner cartridges Ky, Km, and Kc, the K toner cartridge Kk has the first cartridge Kk1 and the second cartridge Kk2. Accordingly, as the K cartridge motor box MB2*k*, a first cartridge motor box (first cartridge drive) MB2*k*1 for the first cartridge Kk1 and a second cartridge motor box (second cartridge drive) MB2*k*2 for the second cartridge Kk2 are included. Each of the cartridge motor boxes MB2*k*1 and MB2*k*2 is a unit including a cartridge motor (M2*k*1, M2*k*2 (not shown)), a reduction gear for reducing the rotation speed of the cartridge motor, and a coupling for transmitting rotation of the reduction gear. Therefore, as the cartridge motor rotates, the rotation force is transmitted through the coupling and the cartridge agitator 51*k* and the rotation transport member 52*k* are rotated for replenishing the reserve tank H2*k* with toner in the toner cartridge Kk.

The cartridge agitator 51*k* and the rotation transport member 52*k*, and the like make up a cartridge transport member (51+52).

Description of Control Section of Embodiment

Figure 7:
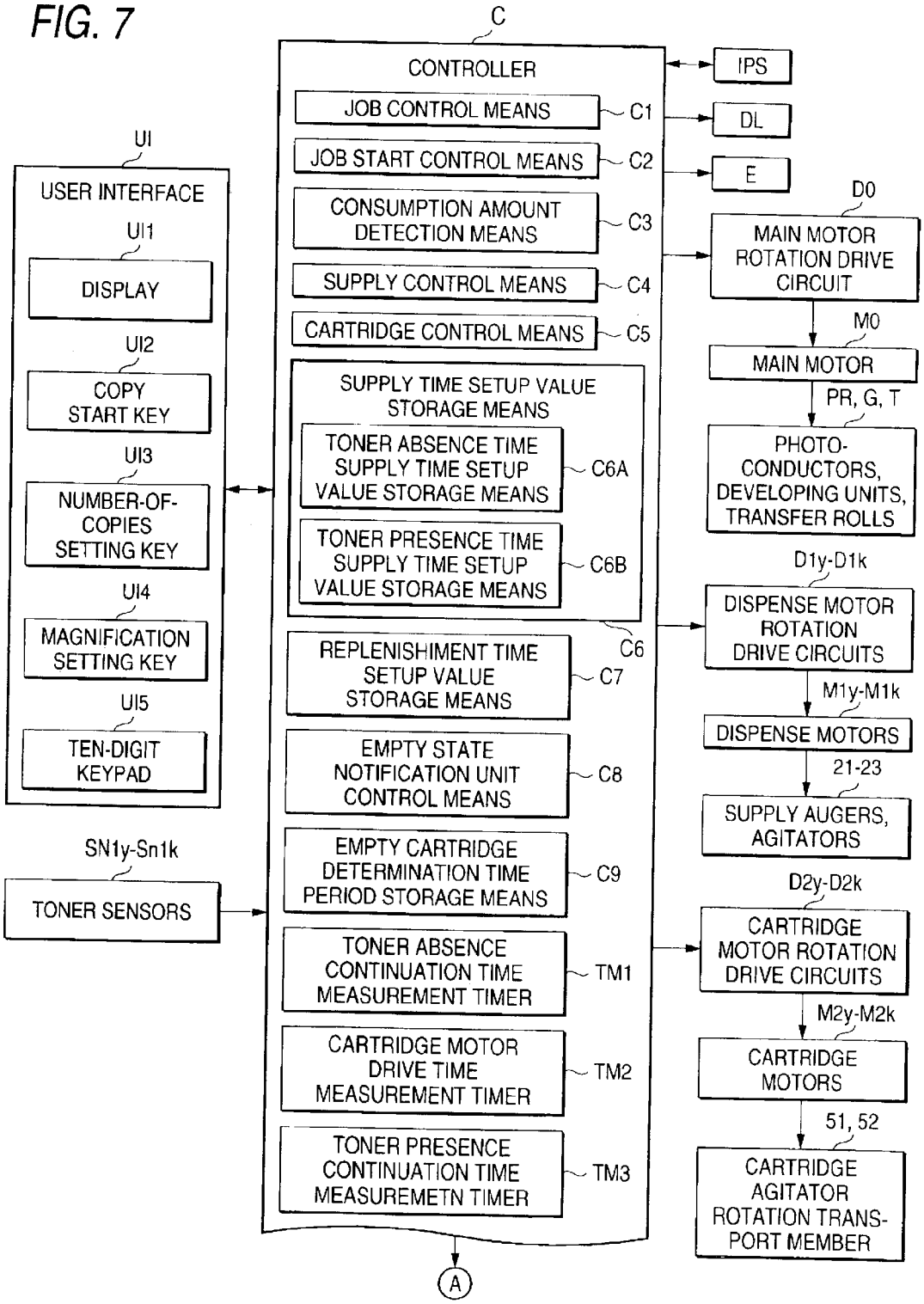
FIG. 7 is a block diagram of functions of a control section of the image formation apparatus of the first embodiment (functional block diagram)

FIG. 7 is a block diagram of functions of a control section of the image formation apparatus of the first embodiment (functional block diagram).

Figure 8:
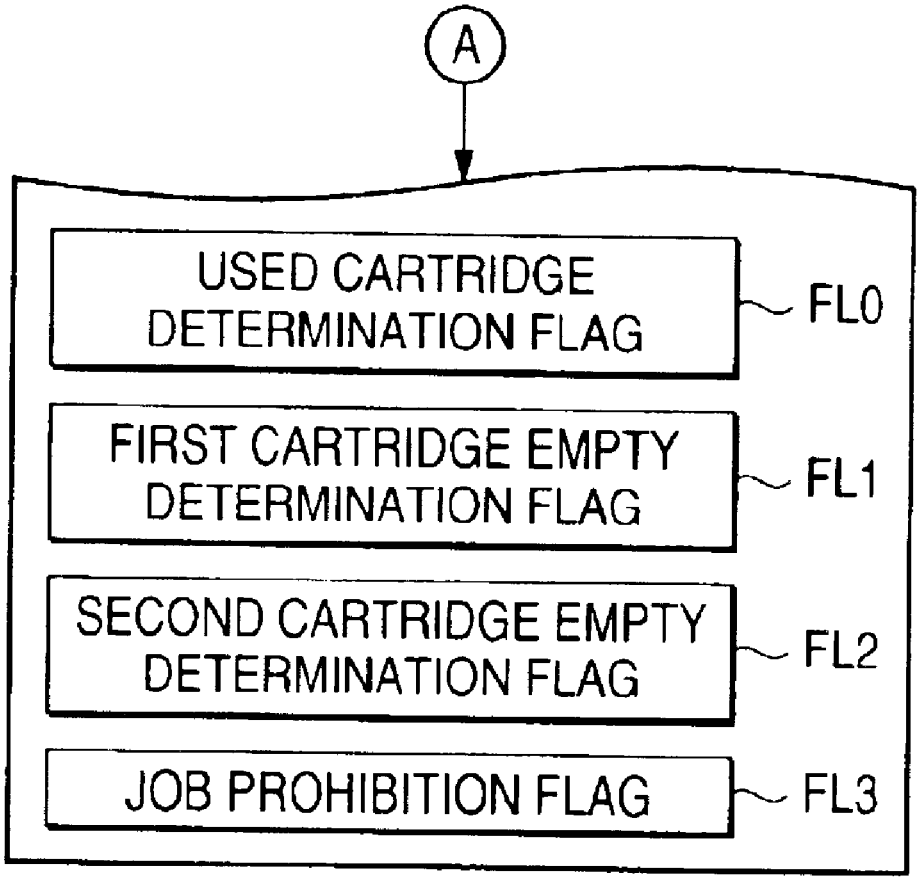
FIG. 8 is a block diagram of the functions of the control section of the image formation apparatus of the first embodiment (functional block diagram) and is a continuation of FIG. 7.

FIG. 8 is a block diagram of the functions of the control section of the image formation apparatus of the first embodiment (functional block diagram) and is a continuation of FIG. 7.

In FIGS. 7 and 8, a controller C is implemented as a computer having an I/O (input/output interface) for inputting/outputting an external signal, adjusting the input/output signal level, etc., ROM (read-only memory) storing a program, data, etc., required for performing necessary processing, RAM (random access memory) for temporarily storing necessary data, a CPU (central processing unit) for performing processing responsive to the program stored in the ROM, a clock oscillator, etc., and can execute the program stored in the ROM, thereby providing various functions.

Signal Input Elements Connected to the Controller C

Signals from a UI (user interface), a power switch SW, the toner sensors SN1*y*, SN1*m*, SN1*c*, and SN1*k*, and other signal input elements are input to the controller C.

The UI comprises a display UI1, a copy start key UI2, a number-of-copies setting key UI3, a magnification setting key UI4, a ten-digit keypad UI5, etc.

Each of the toner sensors SN1*y*, SN1*m*, SN1*c*, and SN1*k* detects the presence or absence of toner in the proximity of each of the toner sensors SN1*y*, SN1*m*, SN1*c*, and SN1*k*.

Control Elements Connected to the Controller C

The controller C is connected to the IPS (image processing system), the DL (laser driver or laser drive circuit), the power supply circuit E, a main motor rotation drive circuit D0, dispense motor rotation drive circuits D1*y*, D1*m*, D1*c*, and D1*k*, cartridge motor rotation drive circuits D2*y*, D2*m*, D2*c*, and D2*k*, and other control elements, and outputs their operation control signals. The power supply circuit E supplies electric power to various drive circuits, motors, heaters, etc.

The main motor rotation drive circuit D0 rotates the toner image supports (photoconductors) PR (PRy, PRm, PRc, and PRk), the developing units G (Gy, Gm, Gc, and Gk), and the transfer roll T through a main motor M0.

The dispense motor rotation drive circuits D1*y*, D1*m*, D1*c*, and D1*k* rotate the agitators 21*y*, 21*m*, 21*c*, and 21*k*, 22*y*, 22*m*, 22*c*, and 22*k* and the supply augers 23*y*, 23*m*, 23*c*, and 23*k* through the dispense motors M1*y*, M1*m*, M1*c*, and M1*k* of the dispense motor boxes MB1*y*, MB1*m*, MB1*c*, and MB1*k*.

The cartridge motor rotation drive circuits D2*y*, D2*m*, D2*c*, and D2*k* rotate the cartridge agitators 51*y*, 51*m*, 51*c*, and 51*k* and the rotation transport members 52*y*, 52*m*, 52*c*, and 52*k* through the cartridge motors M2*y*, M2*m*, M2*c*, and M2*k* of the cartridge motor boxes MB2*y*, MB2*m*, MB2*c*, and MB2*k*.

Functions of the Controller C

The controller C has functions of executing processing responsive to the input signals from the signal output elements and outputting control signals to the control elements.

That is, the controller C has the following functions:

C1: Job Control Means

The job control means C1 controls the operation of the photoconductors PRy, PRm, PRc, and PRk, the charger CR, the latent image formation optical system ROS, the developing units Gy, Gm, Gc, and Gk, the transfer unit T, the fuser F, the sheet transport units (Ra-Rs), etc., in response to input of the copy start key UI2, and executes a job of image record operation (copy operation, namely, image formation operation).

C2: Job Start Control Means

The job start control means C2 controls so as to start the job when the fixing area temperature becomes equal to or more than the control temperature setup value at the job start time.

C3: Consumption Amount Detection Means

The consumption amount detection means C3 calculates the consumption amount of toner consumed in each of the developing units Gy, Gm, Gc, and Gk at the image formation operation time for each color from the formed image for detecting the consumption amount.

C4: Supply Control Means

The supply control means C4 controls the dispense motor rotation drive circuits D1*y*, D1*m*, D1*c*, and D1*k* based on the detection result (calculation result) of the consumption amount detection means C3 for supplying toner of the consumption amount in each of the developing units Gy, Gm, Gc, and Gk from each of the reserve tanks H2*y*, H2*m*, H2*c*, and H2*k*.

C5: Cartridge Control Means

The cartridge control means C5 controls the cartridge motor rotation drive circuits D2*y*, D2*m*, D2*c*, and D2*k* based on the detection result of the toner sensors SN1*y*, SN1*m*, SN1*c*, and SN1*k* for replenishing the reserve tanks H2*y*, H2*m*, H2*c*, and H2*k* with toner from the toner cartridges Ky, Km, Kc, and Kk.

C6: Supply Time Setup Value Storage Means

The supply time setup value storage means C6 stores the setup values of the supply times of the toner cartridges Ky, Km, Kc, and Kk being used. The supply time refers to the integration time of operation of each of the dispense motors M1*y*, M1*m*, M1*c*, and M1*k* if each of the toner sensors SN1*y*, SN1*m*, SN1*c*, and SN1*k* continuously detects the presence of toner or the absence of toner. The supply time setup value storage means C6 has toner absence time supply time setup value storage means C6A for storing a toner absence time supply time ta of the setup value of the supply time if each of the toner sensors SN1*y*, SN1*m*, SN1*c*, and SN1*k* continuously detects the absence of toner (in the embodiment, 0.5 seconds) and toner presence time supply time setup value storage means C6B for storing a toner presence time supply time tc of the setup value of the supply time if each of the toner sensors SN1*y*, SN1*m*, SN1*c*, and SN1*k* continuously detects the presence of toner (in the embodiment, 7 seconds)

C7: Replenishment Time Setup Value Storage Means

The replenishment time setup value storage means C7 stores a replenishment time tb of the time period of operating the cartridge transport member (51+52) of the toner cartridges Ky, Km, Kc, and Kk being used (in the embodiment, 10 seconds).

C8: Empty State Notification Unit Control Means

The empty state notification unit control means C8 controls the display UI1 so as to display the empty state of each of the toner cartridges Ky, Km, Kc, and Kk on the display UI1. (empty state notification unit) of the UI if it is made impossible to set the detection result of each of the toner sensors SN1*y*, SN1*m*, SN1*c*, and SN1*k* to the presence of toner when each of the toner cartridges Ky, Km, Kc, and Kk is used. In the first embodiment, the display UI1 is used as the empty state notification unit, but any desired notification unit such as a buzzer or an empty state notification lamp can be used in place of the display UI1.

C9: Empty Cartridge Determination Time Period Storage Means

The empty cartridge determination time period storage means C9 stores an empty cartridge determination time period td required for determining that each of the toner cartridges Ky, Km, Kc, and Kk being used becomes empty of toner and enters an empty state (in the embodiment, 25 seconds).

TM1: Toner Absence Continuation Time Measurement Timer

The toner absence continuation time measurement timer TM1 measures the integration time (supply time) of operation of each of the dispense motors M1*y*, M1*m*, M1*c*, and M1*k* if each of the dispense motors M1*y*, M1*m*, M1*c*, and M1*k* operates when each of the toner sensors SN1*y*, SN1*m*, SN1*c*, and SN1*k* detects the absence of toner.

TM2: Cartridge Motor Drive Time Measurement Timer

The cartridge motor drive time measurement timer TM2 measures the integration time (replenishment time) of operation of each of the cartridge motors M2*y*, M2*m*, M2*c*, and M2*k* when replenishment is conducted from each of the toner cartridges Ky, Km, Kc, and Kk.

TM3: Toner Presence Continuation Time Measurement Timer

The toner presence continuation time measurement timer TM3 measures the integration time (supply time) of operation of each of the dispense motors M1*y*, M1*m*, M1*c*, and M1*k* if each of the dispense motors M1*y*, M1*m*, M1*c*, and M1*k* operates when each of the toner sensors SN1*y*, SN1*m*, SN1*c*, and SN1*k* detects the presence of toner.

The timers TM1 to TM3 are provided for each of the colors Y, M, C, and K.

FL0: Used Cartridge Determination Flag

The used cartridge determination flag FL0 is set to "0" while the first cartridge Kk1 of the K toner cartridges Kk is used; the flag FL0 is set to "1" while the second cartridge Kk2 is used. The value of the used cartridge determination flag FL0 is stored in nonvolatile memory of the controller C; it is not initialized if the power of the image formation apparatus U is turned off. Therefore, when the power is again turned on, the toner cartridge Kk being used when the power was turned off is used.

FL1: First Cartridge Empty Determination Flag

The first cartridge empty determination flag FL1 has an initial value of "0" and when it is determined that the first cartridge Kk1 becomes empty of toner (the first cartridge Kk1 is empty), FL1 is set to "1."

FL2: Second Cartridge Empty Determination Flag

The second cartridge empty determination flag FL2 has an initial value of "0" and when it is determined that the second cartridge Kk2 becomes empty of toner (the second cartridge Kk2 is empty), FL2 is set to "1."

FL3: Job Prohibition Flag

The job prohibition flag FL3 has an initial value of "0" and when it is determined that both the first cartridge Kk1 and the second cartridge Kk2 become empty or when it is determined that any of the Y, M, and C toner cartridges Ky, Km, and Kc becomes empty, FL3 is set to 1.

Operation of First Embodiment

In the image formation apparatus U of the first embodiment having the described configuration, toner is supplied from each of the developer replenishment units Hy, Hm, Hc, and Hk in response to the consumption amount of toner used at the image formation time in each of the developing units Gy, Gm, Gc, and Gk. Each of the developer replenishment units Hy, Hm, Hc, and Hk is replenished with toner from each of the toner cartridges Ky, Km, Kc, and Kk in response to the detection result of each of the toner sensors SN1*y*, SN1*m*, SN1*c*, and SN1*k*. The supply rate (dispense rate) of toner supplied from the developer replenishment unit Hy, Hm, Hc, Hk varies in response to the number of revolutions of the supply auger 23*y*, 23*m*, 23*c*, 23*k* and the increase or decrease in the storage amount of toner in the reserve tank H2*y*, H2*m*, H2*c*, H2*k*. Therefore, to stably supply toner at a constant dispense rate to the developing unit Gy, Gm, Gc, Gk, toner is replenished from the toner cartridge Ky, Km, Kc, Kk so as to hold almost constant the storage amount of toner in the reserve tank H2*y*, H2*m*, H2*c*, H2*k*.

Figure 9:
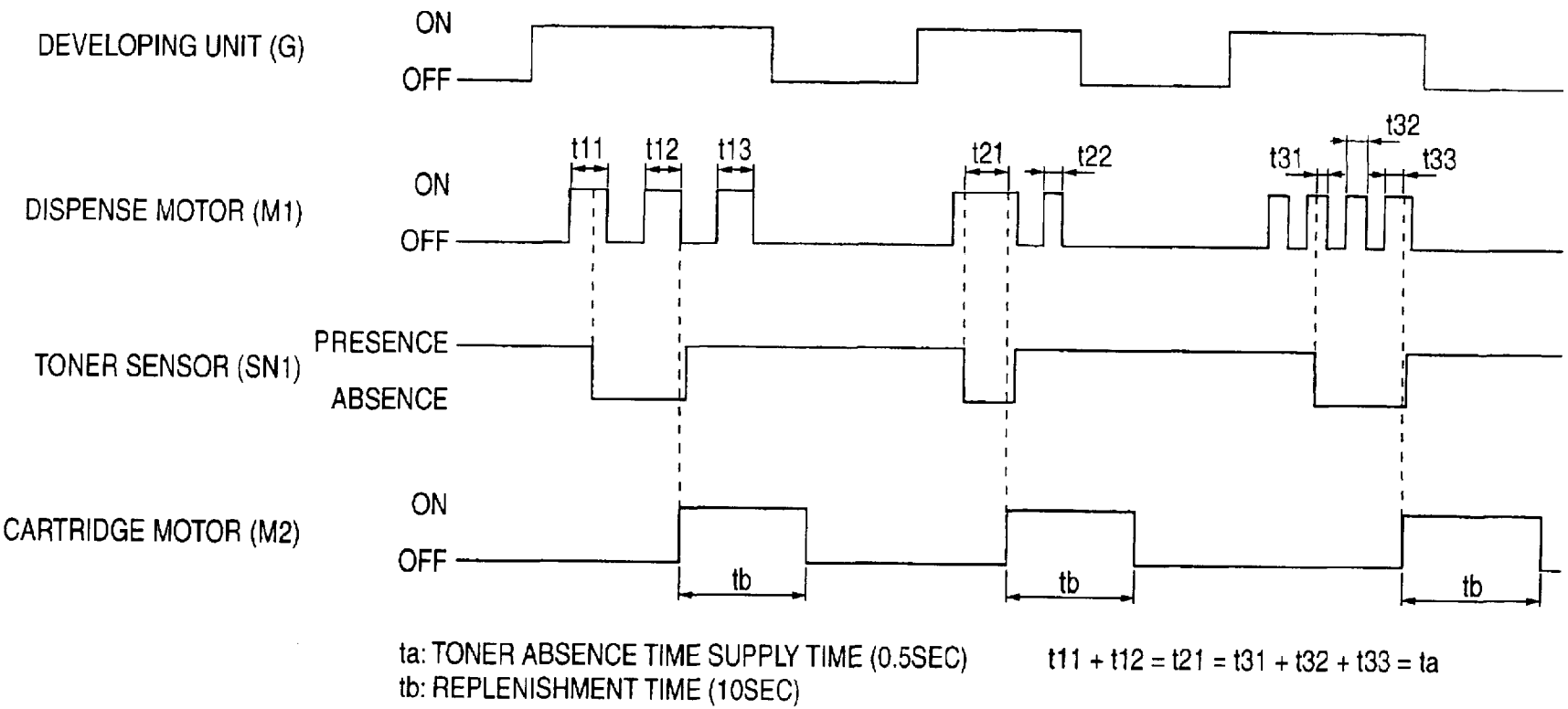
FIG. 9 is a time chart when Y, M, and C toner cartridges and a second K toner cartridge are used.

FIG. 9 is a time chart when the Y, M, and C toner cartridges and the second K toner cartridge are used.

Figure 10:
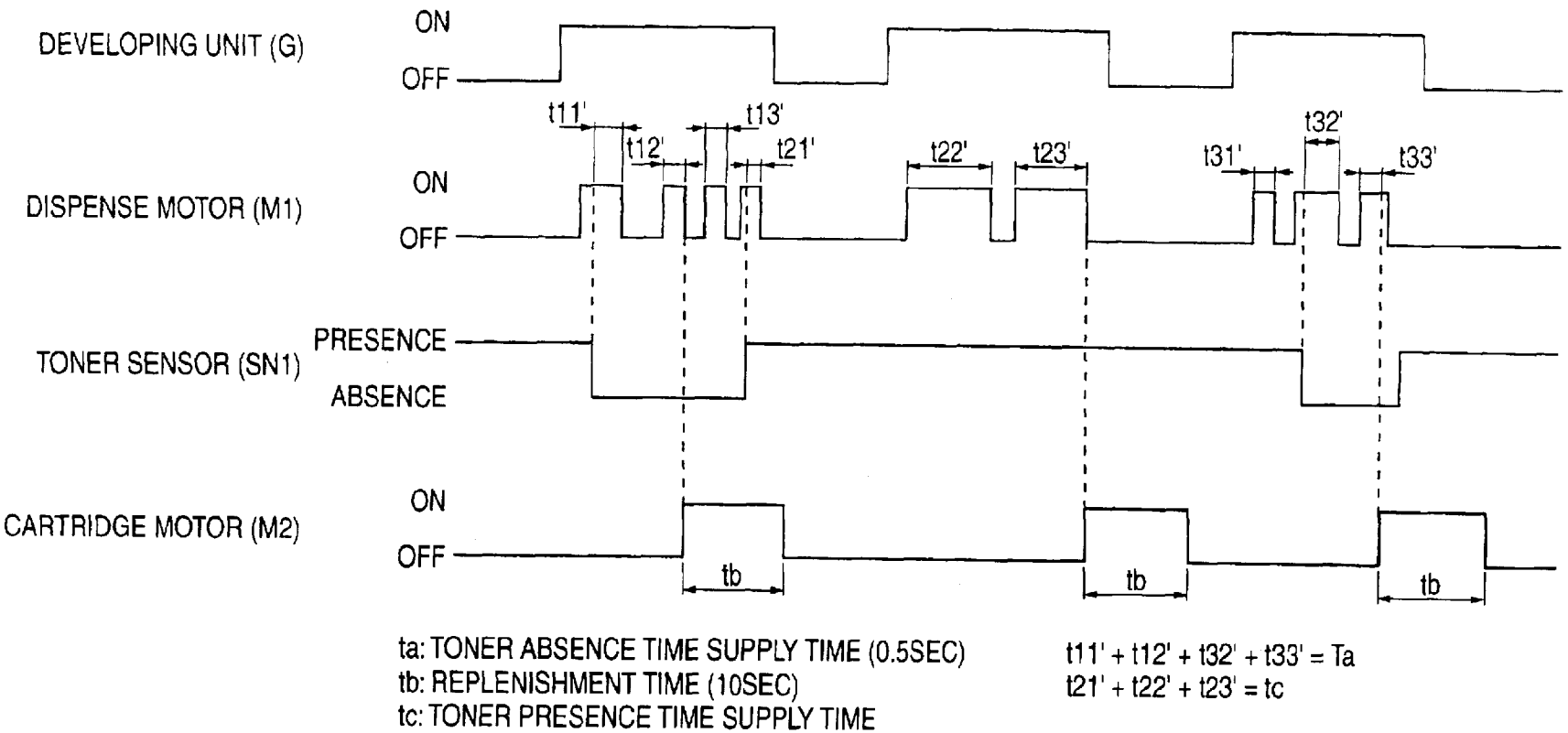
FIG. 10 is a time chart when a first K toner cartridge is used.

FIG. 10 is a time chart when the first K toner cartridge is used.

Next, the developing units Gy, Gm, Gc, and Gk, the detection results of the toner sensors SN1*y*, SN1*m*, SN1*c*, and SN1*k*, and the operation of the dispense motors M1*y*, M1*m*, M1*c*, and M1*k* and the cartridge motors M2*y*, M2*m*, M2*c*, and M2*k* will be discussed with reference to the time charts of FIGS. 9 and 10.

In FIG. 9, when toner is replenished from the Y, M, C toner cartridge Ky, Km, Kc or when the second K toner cartridge Kk2 is used and toner is replenished therefrom, if the user turns on the copy start key UI2 and the image formation operation is started, the developing units G (Gy, Gm, Gc, and Gk) are turned on. The dispense motors M1 (M1*y*, M1*m*, M1*c*, and M1*k*) of the developer replenishment units Hy, Hm, Hc, and Hk are rotated based on the amounts of toner consumed in the developing units Gy, Gm, Gc, and Gk during the image formation operation, and toner is supplied to the developing units Gy, Gm, Gc, and Gk.

When toner is supplied from the dispense motor M1*y*, M1*m*, M1*c*, M1*k* to the developing unit Gy, Gm, Gc, Gk and toner in the reserve tank H2*y*, H2*m*, H2*c*, H2*k* is decreased, the detection result of the toner sensor SN1 (SN1*y*, SN1*m*, SN1*c*, SN1*k*) indicates toner absence. When the toner sensor SN1*y*, SN1*m*, SN1*c*, SN1*k* continuously detects toner absence and the supply time t11+t12 from detection of toner absence (integration time of times t11 and t12 of rotation of the dispense motor M1*y*, M1*m*, M1*c*, M1*k*) becomes the toner absence time supply time ta (0.5 seconds), the cartridge motor M2 (M2*y*, M2*m*, M2*c*, M2*k*2) is turned on. The cartridge motor M2*y*, M2*m*, M2*c*, M2*k*2 is turned on during the replenishment time tb (10 seconds) and meanwhile, the reserve tank H2*y*, H2*m*, H2*c*, H2*k* is replenished with toner from the toner cartridge Ky, Km, Kc, Kk. The toner replenished from the second inflow port 6*by*, 6*bm*, 6*bc*, 6*bk* drops and accumulates in the proximity of the toner sensor SN1*y*, SN1*m*, SN1*c*, SN1*k* and thus when the cartridge motor M2*y*, M2*m*, M2*c*, M2*k*2 is turned on, immediately the detection result of the toner sensor SN1*y*, SN1*m*, SN1*c*, SN1*k* becomes toner presence.

Likewise, when the supply time t21 becomes the toner absence time supply time ta (0.5 seconds) or when the integration time of supply times t31+t32+t33 becomes the toner absence time supply time ta (0.5 seconds), the cartridge motor M2*y*, M2*m*, M2*c*, M2*k*2 is also turned on and toner is replenished.

Therefore, the storage amount of toner in the reserve tank H2*y*, H2*m*, H2*c*, H2*k* is held almost constant based on the correlation of the developing unit Gy, Gm, Gc, Gk, the detection result of the toner sensor SN1*y*, SN1*m*, SN1*c*, SN1*k*, and the operation of the dispense motor M1*y*, M1*m*, M1*c*, M1*k* and the cartridge motor M2*y*, M2*m*, M2*c*, M2*k*2. That is, the dispense rate (toner supply rate from the reserve tank H2*y*, H2*m*, H2*c*, H2*k* to the developing unit Gy, Gm, Gc, Gk) is held almost constant and toner is stably supplied.

Since the dispense rate varies depending on the conditions of the model of image formation apparatus, the environment, etc., the dispense rate can be adjusted by changing the values of the toner absence time supply time ta, the replenishment time tb, and the toner presence time supply time tc.

In FIG. 10, when the first K toner cartridge Kk1 is used and toner is replenished therefrom, if the user turns on the copy start key UI2 and the image formation operation is started, the developing units Gk, Gy, Gm, and Gc are turned on. In this case, the operation of the developing units Gy, Gm, and Gc, the toner sensors SN1*y*, SN1*m*, and SN1*c*, the dispense motors M1*y*, M1*m*, and M1*c*, and the cartridge motors M2*y*, M2*m*, and M2*c* other than K is similar to that previously described with reference to FIG. 9 and therefore only K will be discussed in detail.

The dispense motor M1*k* of the developer replenishment unit Hk is rotated based on the amount of toner consumed in each developing unit Gk during the image formation operation, and toner is supplied to the developing unit Gk. When toner is supplied from the dispense motor M1*k* to each developing unit Gk and toner in the reserve tank H2*k* is decreased, the detection result of the toner sensor SN1*k* indicates toner absence. When the toner sensor SN1*k* continuously detects toner absence and the supply time (t11'+t12') from detection of toner absence becomes the toner absence time supply time ta (0.5 seconds), the cartridge motor M2*k*1 is turned on. The cartridge motor M2*k*1 is turned on during the replenishment time tb (10 seconds) and meanwhile, the reserve tank H2*k* is replenished with toner from the first toner cartridge Kk1. When the supply time (t32'+t33') becomes the toner absence time supply time ta (0.5 seconds), the reserve tank H2*k* is also replenished with toner from the first toner cartridge Kk1.

In FIG. 10, when the first toner cartridge Kk1 is used, unlike the case where the Y, M, and C toner cartridges Ky, Km, and Kc and the second toner cartridge Kk2 are used, even when the detection result of the toner sensor SN1*y*, SN1*m*, SN1*c*, SN1*k* indicates toner presence, when the supply time (t21'+t22'+t23') from detection of toner presence becomes the toner presence time supply time tc (7 seconds), the cartridge motor M2*k*1 is turned on. The cartridge motor M2*k*1 is turned on during the replenishment time tb (10 seconds) and meanwhile, the reserve tank H2*k* is replenished with toner from the toner cartridge Kk.

Consequently, while the first toner cartridge Kk1 is used, even when the detection result of the toner sensor SN1 indicates toner presence, if the supply time (t21+'t22'+t23') becomes the toner presence time supply time tc, toner is replenished.

When the reserve tank H2*k* is replenished with toner from the first toner cartridge Kk1, the toner replenished from the first inflow port 4*bk* drops and accumulates in the first circulation passage 11*k* upstream in the toner transport direction of the toner sensor SN1*k* and thus if the cartridge motor M2*k*1 is turned on, the detection result of the toner sensor SN1*k* does not immediately become toner presence. After replenishing with toner is started, the dispense motor M1*k* is rotated and when the toner is transported to the proximity of the toner sensor SN1*k*, the detection result of the toner sensor SN1*k* becomes toner presence.

Conversely, if replenishing with toner is performed, unless the dispense motor M1*k* is rotated after replenishing with toner is performed, the detection result of the toner sensor SN1*k* is held toner absence. That is, in fact, it takes time from replenishing with toner to the toner sensor SN1*k* detecting toner presence (a time lag occurs). Therefore, to replenish with toner from the first toner cartridge Kk1, although toner is actually replenished to such an extent that a predetermined dispense rate is obtained, the toner sensor SN1*k* does not detect toner presence because of the time lag and thus toner may be excessively replenished. In this case, the dispense rate becomes too large.

In the reserve tank H2*y*, H2*m*, H2*c*, H2*k* as in the first embodiment, when toner is circulated on the circulation passage (11+12), toner accumulates in the downstream end part of the first circulation passage 11*y*, 11*m*, 11*c*, 11*k* (or the downstream end part of the second circulation passage 12*y*, 12*m*, 12*c*, 12*k*) and is pushed by toner later transported and flows into the upstream side of the second circulation passage 12*y*, 12*m*, 12*c*, 12*k* (or the upstream side of the first circulation passage 11*y*, 11*m*, 11*c*, 11*k*). If toner is replenished from the first inflow port 4*bk* after the toner sensor SN1*k* detects toner absence, it takes time until the toner is transported to the downstream end part of the first circulation passage 11*k* where the toner sensor SN1*k* is placed, as described above. Therefore, as compared with the case where toner is replenished from the second inflow port 6*bk*, if toner is replenished from the first inflow port 4*bk*, the toner amount in the downstream end part of the first circulation passage 11*k* lessens until the toner is transported to the downstream end part, and thus the amount of toner flowing from the first circulation passage 11*k* into the second circulation passage 12*k* decreases. Consequently, as compared with the case where toner is replenished from the second inflow port 6*bk*, toner in the second circulation passage 12*k*, the supply passage 13*k* and toner ejected from the supply port 16*k* lessen and the toner supply rate (dispense rate) to the developing unit Gk may lower.

However, in the developer replenishment unit Hy, Hm, Hc, Hk of the first embodiment, the cartridge motor M2*y*, M2*m*, M2*c*, M2*k* (M2*k*1, M2*k*2) drive time is set to the replenishment time tb, whereby over replenishment with toner is decreased and if the detection result of the toner sensor SN1*k* indicates toner presence, when the toner presence time supply time tc has elapsed, toner is replenished, whereby toner shortage in the downstream end part of the first circulation passage 11*k* can be prevented. Therefore, to replenish toner from the first toner cartridge Kk1, a similar dispense rate to that of replenishing toner from the second toner cartridge Kk2 can also be held.

Next, control of the dispense motors M1*y*, M1*m*, M1*c*, and M1*k* and the cartridge motors M2*y*, M2*m*, M2*c*, and M2*k* for replenishing the reserve tanks H2*y*, H2*m*, H2*c*, and H2*k* with toner from the toner cartridges Ky, Km, Kc, and Kk will be discussed wit reference to flowcharts.

Description of Flowchart of Control at Toner Replenishing Time

Figure 11:
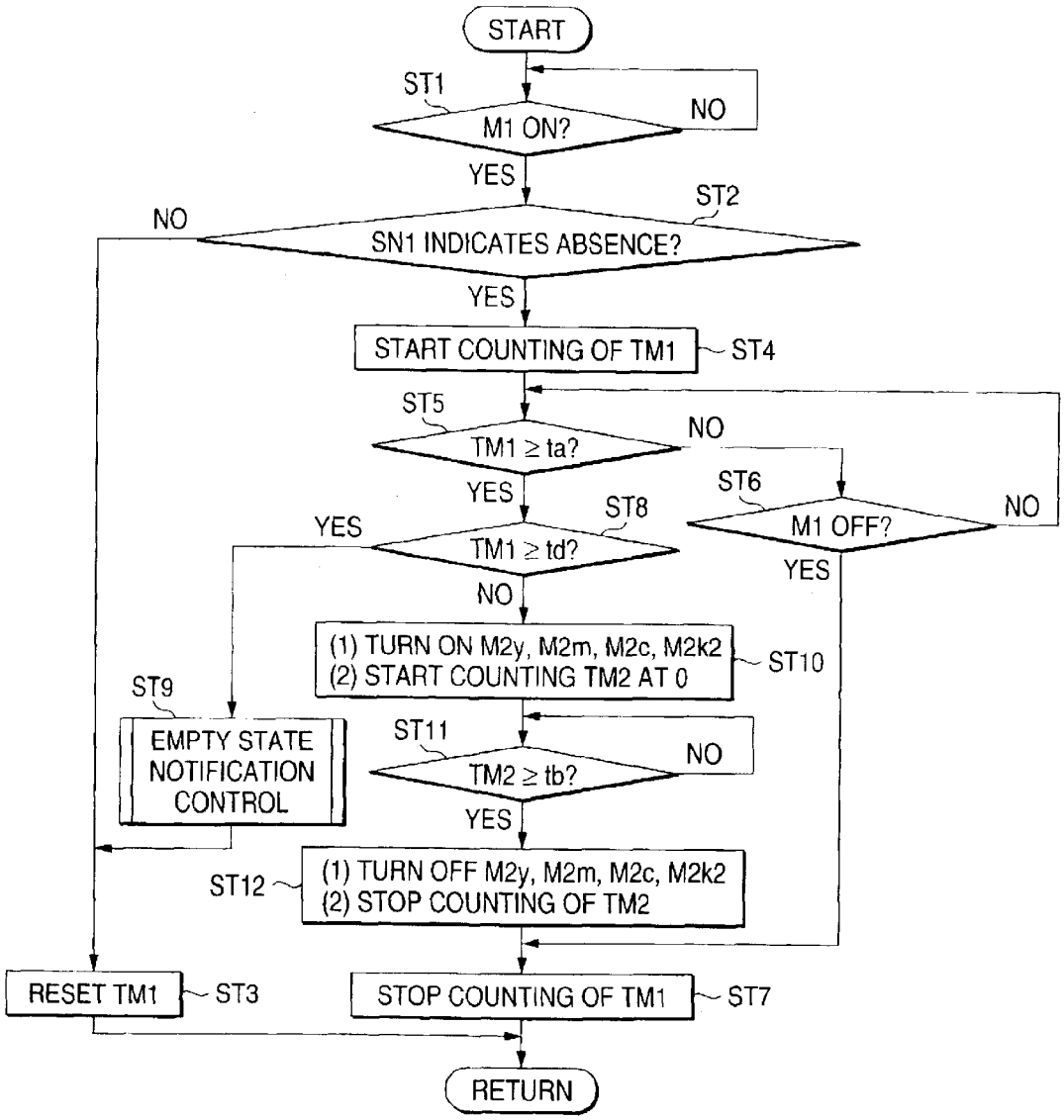
FIG. 11 is a flowchart of a main routine of toner replenishment control to use Y, M, C toner cartridge or second K toner cartridge in the image formation apparatus comprising the developer replenishment units of the first embodiment.

FIG. 11 is a flowchart of a main routine of toner replenishment control to use Y, M, C toner cartridge or second K toner cartridge in the image formation apparatus comprising the developer replenishment units of the first embodiment.

Figure 12:
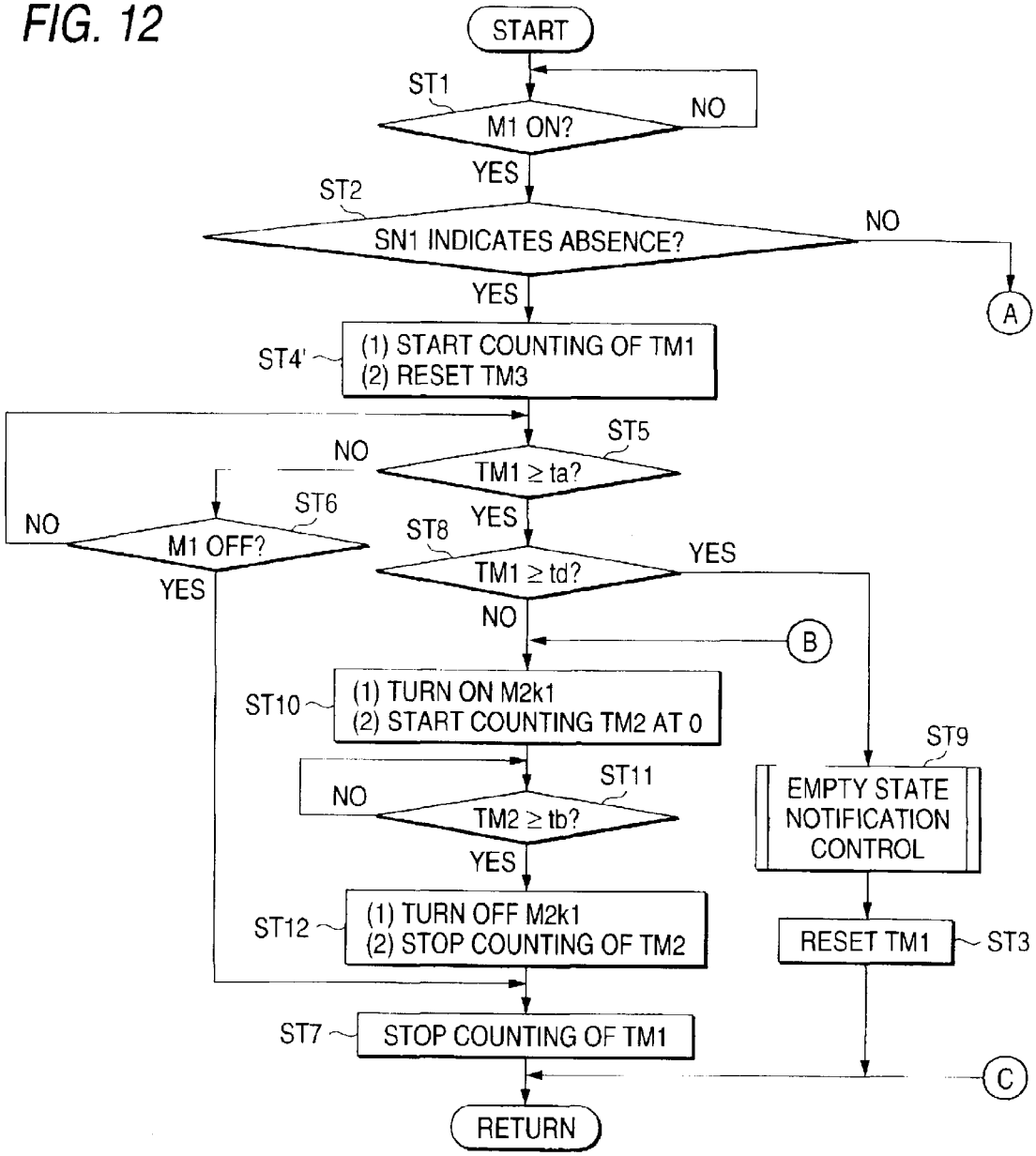
FIG. 12 is a flowchart of a main routine of toner replenishment control to use first K toner cartridge in the image formation apparatus comprising the developer replenishment units of the first embodiment.

FIG. 12 is a flowchart of a main routine of toner replenishment control to use first K toner cartridge in the image formation apparatus comprising the developer replenishment units of the first embodiment.

FIG. 13 is a flowchart continued from the flowchart of FIG. 12.

When the power of the image formation apparatus U is turned on, first the value of the used cartridge determination flag FL0 is determined by performing control processing (not shown). If the value of the used cartridge determination flag FL0 is "1," processing in FIG. 11 is started; if the value of the used cartridge determination flag FL0 is "0," processing in FIGS. 12 and 13 is started. The control processing is performed only for the K toner cartridge Kk and when the power is turned on, flowchart processing similar to that in FIG. 11 is started for the Y, M, and C toner cartridges Ky, Km, and Kc. The control processing and processing of steps (STs) in the flowcharts of FIGS. 11 to 13 are performed in accordance with the program stored in the ROM of the controller C. The processing is executed as multi task operation concurrently with other various types of processing of the image formation apparatus U.

Description of Toner Replenishment Control to Use Y, M, C Toner Cartridge or Second K Toner Cartridge At step (ST) 1 in FIG. 11, whether or not the dispense motor Ml is turned on (starts to rotate) is determined. If the determination returns No (N), ST1 is repeated; if the determination returns Yes (Y), control goes to ST2.

At ST2, whether or not the detection result of the toner sensor SN1 (SN1*y*, SNIm, SN1*c*, SN1*k*) indicates toner absence is determined. If the determination returns No (N), control goes to ST3; if the determination returns Yes (Y), control goes to ST4.

At ST3, the measurement time of the toner absence continuation time measurement timer TM1 is initialized (reset) to 0. Then, control returns to ST1.

Therefore, as steps of ST1 to ST3 are executed, if the detection result of the toner sensor SN1 indicates toner presence when the dispense motor M1*y*, M1*m*, M1*c*, M1*k* rotates, the toner storage amount in the reserve tank H2*y*, H2*m*, H2*c*, H2*k* is sufficient and thus the cartridge motor M2*y*, M2*m*, M2*c*, M2*k*2, etc., is not controlled and toner is not replenished.

At ST4, counting (integration) of the toner absence continuation time measurement timer TM1 is started. Then, control returns to ST5.

At ST5, whether or not the count (integration time) of the toner absence continuation time measurement timer TM1 reaches the toner absence time supply time ta is determined. If the determination returns No (N), control goes to ST6; if the determination returns Yes (Y), control goes to ST8.

At ST6, whether or not the dispense motor M1*y*, M1*m*, M1*c*, M1*k* is turned off (stops rotating) is determined. If the determination returns No (N), control returns to ST5 and counting (integration) of the toner absence continuation time measurement timer TM1 is continued; if the determination returns Yes (Y), control goes to ST7.

At ST7, counting of the toner absence continuation time measurement timer TM1 is stopped. Then, control returns to ST1.

Therefore, as steps of ST4 to ST7 are executed, if the detection result of the toner sensor SN1 indicates toner absence, unless the count of the toner absence continuation time measurement timer TM1 of the dispense motor M1*y*, M1*m*, M1*c*, M1*k* supply time (rotation time integration value) reaches the toner absence time supply time ta, the cartridge motor M2*y*, M2*m*, M2*c*, M2*k*2, etc., does not operate and toner is not replenished.

At ST8, whether or not the count of the toner absence continuation time measurement timer TM1 reaches the empty cartridge determination time period td is determined. If the determination returns Yes (Y), control goes to ST9; if the determination returns No (N), control goes to ST10.

At ST9, processing of empty state notification control is performed. The empty state notification control processing is described later with reference to FIG. 13. Then, control goes to ST3.

As steps ST8 and ST9 are executed, when the count (integration time) of the toner absence continuation time measurement timer TM1 when the detection result of the toner sensor SN1 indicates toner absence reaches the empty cartridge determination time period td, it is determined that the toner cartridge Ky, Km, Kc, Kk becomes empty of toner, and the user is notified that the toner cartridge Ky, Km, Kc, Kk is empty. If the K cartridge is empty, the cartridge Kk is switched.

At ST10, the following (1) and (2) are performed:

(1) The cartridge motor M2 (M2*y*, M2*m*, M2*c*, M2*k*2) is turned on (rotating the cartridge motor is stated); and (2) the cartridge motor drive time measurement timer TM2 is reset to 0 and then counting the timer is started.

Then, control returns to ST11.

At ST11, whether or not the count (integration time) of the cartridge motor drive time measurement timer TM2 is equal to or greater than the replenishment time tb is determined. If the determination returns No (N), ST11 is repeated until the determination returns Yes (Y); if the determination returns Yes (Y), control goes to ST12.

At ST12, the following (1) and (2) are performed:

(1) The cartridge motor M2 (M2*y*, M2*m*, M2*c*, M2*k*2) is turned off (rotating the cartridge motor is stopped); and (2) counting the cartridge motor drive time measurement timer TM2 is stopped.

Then, control returns to ST7.

Therefore, as steps of ST10 to ST12 are executed, if the detection result of the toner sensor SN1*y*, SN1*m*, SN1*c*, SN1*k* indicates toner absence, when the toner absence time supply time ta has elapsed, the cartridge motor M2*y*, M2*m*, M2*c*, M2*k*2 is turned on and the reserve tank H2*y*, H2*m*, H2*c*, H2*k* is replenished with toner. If the reserve tank is replenished with toner, the toner absence continuation time measurement timer TM1 is not reset and continues to count the time until the detection result of the toner sensor SN1*y*, SN1*m*, SN1*c*, SN1*k* indicates toner presence or the empty toner cartridge is replaced with a new one. That is, if the cartridge motor M2*y*, M2*m*, M2*c*, M2*k*2 is turned on and the reserve tank H2*y*, H2*m*, H2*c*, H2*k* is replenished with toner, when the empty cartridge determination time period td has elapsed while the detection result of the toner sensor SN1*y*, SN1*m*, SN1*c*, SN1*k* indicates toner absence, it is determined that the toner cartridge Ky, Km, Kc, Kk becomes empty as ST8 and ST9 are executed.

Description of Toner Replenishment Control to Use First K Toner Cartridge

Next, toner replenishment control when the first K toner cartridge Kk1 is used will be discussed with reference to FIGS. 12 and 13. Steps identical with those previously described with reference to FIG. 11 are denoted by the same step numbers in FIGS. 12 and 13 and will not be discussed again in detail.

Like ST1 in FIG. 11, ST1 in FIG. 12 is repeated until the dispense motor M1 (M1*k*) is turned on before control goes to ST2.

At ST2 in FIG. 12 like ST2 in FIG. 11, whether or not the detection result of the toner sensor SN1 (SN1*k*) indicates toner absence is determined. If the determination returns Yes (Y), control goes to ST4'; if the determination returns No (N), control goes to ST20 in FIG. 13.

At ST4', the following (1) and (2) are executed:

(1) Counting (integration) of the toner absence continuation time measurement timer TM1 is started; and (2) the count (integration time) of the toner presence continuation time measurement timer TM3 is reset.

Then, control goes to ST5.

At ST5, whether or not the count (integration time) of the toner absence continuation time measurement timer TM1 is equal to or greater than the toner absence time supply time ta is determined as at ST5 in FIG. 11. If the determination returns No (N), ST6 and ST7 are executed and control returns to ST1 as in FIG. 11; if the determination returns Yes (Y), control goes to ST8 as in FIG. 11.

At ST8, whether or not the count of the toner absence continuation time measurement timer TM1 is equal to or greater than the empty cartridge determination time period td is determined as in FIG. 11. If the determination returns Yes (Y), ST9 and ST3 are executed in order and control returns to ST1; if the determination returns No (N), ST10, ST11, ST12, and ST7 are executed in order and control returns to ST1 as in FIG. 11. The cartridge motor M2 turned on and off at ST10 and ST12 in FIG. 12 is the first cartridge motor M2*k*1.

Therefore, as ST1 to ST3, ST4', and ST5 to ST12 are executed, if the detection result of the toner sensor SN1*k* indicates toner absence, when the count (integration time) of the toner absence continuation time measurement timer TM1 reaches the toner absence time supply time ta, toner is replenished as in FIG. 13. When the count (integration time) of the toner absence continuation time measurement timer TM1 reaches the empty cartridge determination time period td, it is determined that the first toner cartridge Kk1 becomes empty.

At ST20 in FIG. 13, the following (1) and (2) are executed:

(1) Counting (integration) of the toner presence continuation time measurement timer TM3 is started; and (2) the count (integration time) of the toner absence continuation time measurement timer TM1 is reset.

Then, control goes to ST21.

At ST21, whether or not the count (integration time) of the toner presence continuation time measurement timer TM3 is equal to or greater than the toner presence time supply time tc is determined. If the determination returns Yes (Y), control goes to ST10'; if the determination returns No (N), control goes to ST22.

At ST22, whether or not the dispense motor M1*k* is turned off (stops rotating) is determined. If the determination returns No (N), control returns to ST21; if the determination returns Yes (Y), control goes to ST23.

At ST23, counting (integration) of the toner presence continuation time measurement timer TM3 is stopped. Then, control returns to ST1.

Therefore, as ST20 to ST23 and other steps are executed, if the detection result of the toner sensor SN1*k* indicates toner presence, when the count (integration time) of the toner presence continuation time measurement timer TM3 reaches the toner presence time supply time tc, the reserve tank H2*k* is replenished with toner.

Description of Empty State Notification Control Processing

Figure 14:
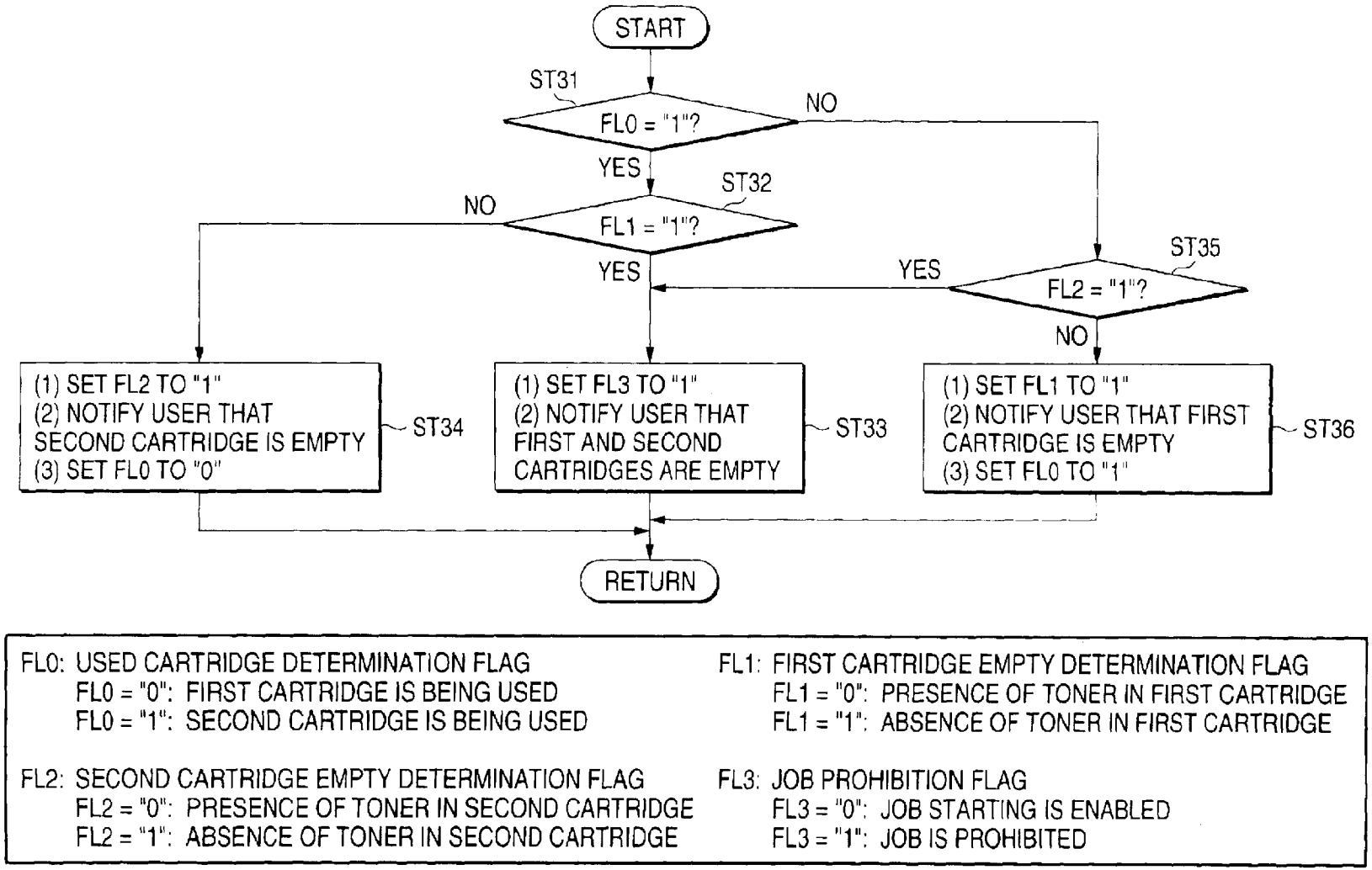
FIG. 14 is a schematic representation of a flowchart of empty state notification control processing and is a schematic representation of a subroutine at ST9 in FIGS. 11 and 12.

FIG. 14 is a schematic representation of a flowchart of the empty state notification control processing and is a schematic representation of the subroutine at ST9 in FIGS. 11 and 12.

Next, the subroutine of the empty state notification control processing at ST9 in FIGS. 11 and 12 will be discussed.

At ST31 in FIG. 14, whether or not the value of the used cartridge determination flag FL0 is "1" is determined. If the determination returns Yes (Y), control goes to ST32; if the determination returns No (N), control goes to ST35.

At ST32, whether or not the value of the first cartridge empty determination flag FL1 is "1" is determined. If the determination returns Yes (Y), control goes to ST33; if the determination returns No (N), control goes to ST34.

At ST33, the following (1) and (2) are executed:

(1) The value of the job prohibition flag FL3 is set to "1;" and (2) a message indicating that the first K toner cartridge Kk1 and the second toner cartridge Kk2 become empty is displayed on the display UI1 of the user interface UI.

Then, control returns to ST3 in FIG. 11 or 12.

Therefore, if it is determined that the second toner cartridge Kk2 being used at present becomes empty as ST31 is executed and it is also determined that the first toner cartridge Kk1 becomes empty as ST32 is executed, both the first K toner cartridge Kk1 and the second toner cartridge Kk2 are empty. Therefore, as ST33 is executed, the user is notified that both the first K toner cartridge Kk1 and the second toner cartridge Kk2 are empty, and the job is prohibited. For Y, M, C, only one toner cartridge Ky, Km, Kc is placed and thus if it is determined that the toner cartridge is empty, only ST33 is executed and ST31 and ST32 and ST34 to ST36 described later are skipped.

At ST34, the following (1) to (3) are executed:

(1) The value of the second cartridge empty determination flag FL2 is set to "1;"

(2) a message indicating that the second toner cartridge Kk2 becomes empty is displayed on the display UI1 of the user interface UI; and (3) the value of the used cartridge determination flag FL0 is "0."

Then, control returns to ST3 in FIG. 11 or 12.

Therefore, if it is determined that the second toner cartridge Kk2 being used at present becomes empty as ST31 is executed and it is not determined that the first toner cartridge Kk1 is empty as ST32 is executed, as ST34 is executed, the user is notified that the second toner cartridge Kk2 becomes empty, and the toner cartridge Kk used is switched from the second toner cartridge Kk2 to the first toner cartridge Kk1. That is, when the toner cartridge Kk is switched as ST34 is executed, the control processing is also switched from the flowchart of FIG. 11 for performing the control processing so far to the flowcharts of FIGS. 12 and 13.

At ST35, whether or not the value of the second cartridge empty determination flag FL2 is "1" is determined. If the determination returns Yes (Y), control goes to ST33; if the determination returns No (N), control goes to ST36.

At ST36, the following (1) to (3) are executed:

(1) The value of the first cartridge empty determination flag FL1 is set to "1;"

(2) a message indicating that the first toner cartridge Kk1 becomes empty is displayed on the display UI1 of the user interface UI; and (3) the value of the used cartridge determination flag FL0 is "1."

Then, control returns to ST3 in FIG. 11 or 12.

Therefore, if it is determined that the first toner cartridge Kk1 being used becomes empty as ST31 is executed and it is also determined that the second toner cartridge Kk2 is empty as ST35 is executed, as ST33 is executed, the user is notified that both the first K toner cartridge Kk1 and the second toner cartridge Kk2 are empty, and the job is prohibited. If it is not determined that the second toner cartridge Kk2 is empty as ST35 is executed, as ST36 is executed, the user is notified that the first toner cartridge Kk1 becomes empty, and the toner cartridge Kk used is switched from the first toner cartridge Kk1 to the second toner cartridge Kk2. When the toner cartridge is switched as ST36 is executed, the control processing is also switched from the flowchart of FIG. 12 for performing the control processing so far to the flowchart of FIG. 11.

The values of the first cartridge empty determination flag FL1, the second cartridge empty determination flag FL2, and the job prohibition flag FL3 are stored in the nonvolatile memory and are not initialized if the power of the image formation apparatus U is turned off. Therefore, when the toner cartridge Kk is replaced, the user presses a job prohibition release button (not shown), thereby initializing all the values of the first cartridge empty determination flag FL1, the second cartridge empty determination flag FL2, and the job prohibition flag FL3 to "0" for releasing job prohibition manually. It is also possible to automatically release job prohibition by a sensor for detecting a cartridge being attached or detached or the like instead of releasing job prohibition manually.

Therefore, in the image formation apparatus U comprising the developer replenishment units Hy, Hm, Hc, and Hk of the first embodiment, one reserve tank H2*k* is replenished with toner from the two cartridges of the first toner cartridge Kk1 and the second toner cartridge Kk2, and the toner storage amount in the reserve tank H2*k* is detected by one tone sensor SN1*k*. Therefore, as compared with the case where toner sensors are provided in a one-to-one correspondence with cartridges for detecting the presence or absence of toner in each of the cartridges or toner sensors are placed in reserve tanks provided in a one-to-one correspondence with cartridges in the related art, the image formation apparatus U of the first embodiment makes it possible to decrease the number of the toner sensors SN1*y*, SN1*m*, SN1*c*, and SN1*k* and reduce the cost. If the reserve tank is replenished with toner from either of the first toner cartridge Kk1 and the second toner cartridge Kk2, the dispense rate can be held almost constant by one toner sensor SN1*k*, as described above.

The K toner cartridge Kk containing toner frequently used and more consumed than any other color toner has a similar shape to that of any other color toner cartridge Ky, Km, Kc, and two K toner cartridges are placed, so that the K toner amount is twice the amount of any other color toner. Therefore, image formation can be performed until both the first toner cartridge Kk1 and the second toner cartridge Kk2 become empty of toner, and when both cartridges become empty, they are replaced at a time, whereby the number of replacement times can be decreased and the burden on the user can be reduced.

Further, since the shape of the toner cartridge Kk is not put into a large capacity as compared with any other color toner cartridge Ky, Km, Kc, the K toner cartridge Kk is not large or heavy and the burden on the user at the cartridge replacing time can be reduced. Since the toner cartridge Kk is not put into a large capacity, the load on the cartridge motor can also be decreased and a low-cost motor can be used. Further, since all color toner cartridges Ky, Km, Kc, and Kk have similar shapes, the components can be made common and the toner cartridge cost can be suppressed.

Further, the developer replenishment units Hy, Hm, Hc, and Hk of the first embodiment comprise the reserve tanks H2*y*, H2*m*, H2*c*, and H2*k* and thus if the developers in all placed toner cartridges Ky, Km, Kc, and Kk run out, it is not necessary to immediately prohibit the image formation operation and the image formation operation can be continued in the developer in the reserve tank for a while.

Modifications

Although the embodiment of the invention has been described in detail, it is understood that the invention is not limited to the embodiment and the combination and arrangement of parts may be resorted to without departing from the spirit and the scope of the invention as claimed. Modifications (H01) to (H04) of the invention are illustrated below:

(H01) The embodiment of the invention can be applied not only to the tandem image formation apparatus, but also to an image formation apparatus comprising a rotary developing unit or a retractor developing unit.

(H02) The embodiment of the invention can be applied not only to the full-color image formation apparatus, but also to a monochrome image formation apparatus, etc.

(H03) In the embodiment, it is also possible to make it possible to place three or more K toner cartridges Kk.

(H04) In the embodiment, it is also possible to make it possible to place two or more cartridges of any other color Ky, Km, Kc in addition to the K toner cartridges Kk.

The developer replenishment units and the image formation apparatus of the invention described above can provide the following advantages (E01) to (E04):

(E01) The burden on the user at the cartridge replacing time as a cartridge containing toner frequently used and consumed in a large amount is put into a large capacity can be decreased and the cost can also be reduced.

(E02) When the toner in the placed toner cartridge runs out, the image formation operation is not immediately prohibited and can be continued.

(E03) The presence or absence of toner in all toner cartridges can be detected without providing without providing a reserve tank and without providing a remaining amount sensor for each toner cartridge.

What is claimed is:

1. A developer replenishment unit, comprising:

(A01) at least two cartridge placement members;

(A02) a reserve tank including an inflow port into which developer flow, a circulation passage for circulating the influent developer, and a supply port for ejecting the developer circulating in the circulation passage;

(A03) a supply transport member being supported for rotation in the reserve tank for ejecting the developer in the reserve tank from the supply port when the supply transport member rotates;

(A04) a developer transport member for transporting the developer ejected from the supply port to a developing unit for developing an electrostatic latent image formed on an image support surface to a toner image;

(A05) a cartridge drive;

(A06) a supply drive for rotating the supply transport member;

(A07) a storage amount sensor for sensing whether or not the storage amount of the developer in the reserve tank is a predetermined amount or more; and (A08) a cartridge controller;

wherein at least two developer cartridges including first and second cartridge are detachably and respectively placed in the cartridge placement members;

each of the first and second cartridges has a developer replenishment vessel for storing the developer therein, the developer replenishment vessel having a replenishment port for ejecting the stored developer, and a cartridge transport member being supported for rotation in the developer replenishment vessel for ejecting the developer from the replenishment port when the cartridge transport member rotates;

the developer is ejected from the replenishment ports of the first cartridges and the second cartridges to flow into the inflow port;

the cartridge drive includes a first cartridge drive and a second cartridge drive for separately rotating the cartridge transport members of the first cartridge and the second cartridge; and the cartridge controller controls operation of the cartridge drive so that a detection value of the storage amount sensor indicates presence.

2. The developer replenishment unit as claimed in claim 1, further comprising:

(A09) an empty state notification unit for notifying the user that when either the first cartridge or the second cartridge is used, the cartridge being used becomes empty; and (A10) an empty state notification unit controller which operates the empty state notification unit if it is made impossible for the detection value of the storage amount sensor to indicate presence when either the first cartridge or the second cartridge is used.

3. The developer replenishment unit as claimed in claim 1, further comprising:

(A011) a consumption amount detection unit which detects consumption amount of the developer of the developing unit; and (A012) a supply control unit which controls operation of the supply drive so as to eject the developer from the supply port in response to the consumption amount detected by the consumption amount detection unit.

4. The developer replenishment unit as claimed in claim 3, further comprising:

a supply time setup value storage; and a replenishment time setup value storage;

wherein:

the inflow port has a first inflow port and a second inflow port into which the developers ejected from the replenishment ports of the first cartridge and the second cartridge flow separately;

the second inflow port and the first inflow port are placed in order as they are from the storage amount sensor to the upstream side of the circulation passage in the reserve tank;

the first cartridge drive operates the cartridge transport member of the first cartridge for a setup replenishment time for replenishing the reserve tank with the developer in the first cartridge each time a supply time of an operation time of the supply drive reaches a setup value while the first cartridge is used;

the supply time setup value storage stores the setup value of the supply time while the first cartridge is used; and the replenishment time setup value storage stores the setup value of the replenishment time while the first cartridge is used.

5. An image formation apparatus comprising:

a developing unit having an image support, the developing unit for developing an electrostatic latent image formed on surface of the image support to a toner image; and a developer replenishment unit;

wherein the developer replenishment unit comprises:

at least two cartridge placement members, a reserve tank including an inflow port into which developer flow, a circulation passage for circulating the influent developer, and a supply port for ejecting the developer circulating in the circulation passage, a supply transport member being supported for rotation in the reserve tank for ejecting the developer in the reserve tank from the supply port when the supply transport member rotates, a developer transport member for transporting the developer ejected from the supply port to the developing unit, a cartridge drive, a supply drive for rotating the supply transport member, a storage amount sensor for sensing whether or not the storage amount of the developer in the reserve tank is a predetermined amount or more, and a cartridge controller;

at least two developer cartridges including first and second cartridge are detachably and respectively placed in the cartridge placement members;

each of the first and second cartridges has a developer replenishment vessel for storing the developer therein, the developer replenishment vessel having a replenishment port for ejecting the stored developer, and a cartridge transport member being supported for rotation in the developer replenishment vessel for ejecting the developer from the replenishment port when the cartridge transport member rotates;

the developer is ejected from the replenishment ports of the first cartridges and the second cartridges to flow into the inflow port;

the cartridge drive includes a first cartridge drive and a second cartridge drive for separately rotating the cartridge transport members of the first cartridge and the second cartridge; and the cartridge controller controls operation of the cartridge drive so that a detection value of the storage amount sensor indicates presence.

6. An image formation apparatus, comprising:

Y (yellow), M (magenta), C (cyan), and K (black) color toner image formation units each comprising a rotating image support with a surface passing through a charging area, a latent image formation position, a developing area, a primary transfer area, and a cleaning area in order, a charger for uniformly charging the image support surface in the charging area, a latent image formation unit for forming an electrostatic latent image on the charged image support surface at the latent image formation position, a developing unit for developing the electrostatic latent image to a toner image in the developing area, and a cleaner for collecting in the cleaning area the remaining toner on the image support surface with the toner image primary-transferred to an intermediate transfer belt when the image support surface passes through the primary transfer area, wherein each of the Y (yellow), M (magenta), C (cyan), and K (black) color developing units has a developer vessel for storing a developer containing Y (yellow), M (magenta), C (cyan), K (black) color toner and a developing roll being supported on the developer vessel for rotation for transporting the developer deposited on a surface of the developing roll to the developing area opposed to the image support and developing the electrostatic latent image formed on the image support surface to a toner image;

a belt module having the intermediate transfer belt for passing through the primary transfer areas in order for coming in contact with the image support surfaces of the Y (yellow), M (magenta), C (cyan), and K (black) color toner image formation units in order to which the toner images on the image support surfaces are transferred in order in an overlap manner, a plurality of belt support rolls including a belt drive roll and a plurality of driven rolls for supporting the intermediate transfer belt, a primary transfer device for transferring the toner images on the image support surfaces to the belt surface in the primary transfer area, and a belt frame for supporting the intermediate transfer belt, the belt support rolls, and the primary transfer device;

a secondary transfer device for secondary-transferring the toner images primary-transferred in order onto the intermediate transfer belt onto a record sheet;

a fuser for fixing the toner images secondary-transferred onto the record sheet;

Y (yellow), M (magenta), C (cyan), and K (black) color cartridge placement members in which Y (yellow), M (magenta), C (cyan), and K (black) color developer cartridges having developer replenishment vessels for storing replenishment Y (yellow), M (magenta), C (cyan), and K (black) color developers therein, each of the developer replenishment vessels having a replenishment port for ejecting the stored developer, and cartridge transport members being supported for rotation in the developer replenishment vessels for ejecting the developers from the replenishment ports when the cartridge transport members rotate are placed detachably;

a reserve tank for K (black) color, having an inflow port into which the developers ejected from the replenishment ports of the K (black) color cartridges placed contiguous to each other, the K (black) color cartridges being named first and second cartridges, flow, a circulation passage for circulating the influent developer, and a supply port for ejecting the developer circulating in the circulation passage;

a supply transport member being supported for rotation in the reserve tank for ejecting the developer in the reserve tank from the supply port when the supply transport member rotates; and a K (black) color developer transport member for transporting the K (black) color developer ejected from the supply port to a developing vessel of the K (black) color developing unit.

7. The image formation apparatus as claimed in claim 6, further comprising:

a K (black) color cartridge drive having a first cartridge drive and a second cartridge drive for separately rotating the cartridge transport members of the first cartridge and the second cartridge;

a supply drive for rotating the supply transport member in the K (black) color reserve tank;

a storage amount sensor for sensing whether or not the storage amount of the developer in the K (black) color reserve tank is a predetermined amount or more; and a cartridge control unit for controlling operation of the K (black) color cartridge drive so that a detection value of the storage amount sensor indicates presence.

8. The image formation apparatus as claimed in claim 5 wherein the first cartridge and the second cartridge are of the same shape.

9. The image formation apparatus as claimed in claim 8 wherein the first cartridge and the second cartridge can be replaced separately from the developer replenishment unit.

10. The image formation apparatus as claimed in claim 6 wherein the first K (black) color cartridge, the second K (black) color cartridge, and the Y (yellow), M (magenta), and C (cyan) cartridges are of the same shape.

11. The image formation apparatus as claimed in claim 10, further comprising:

reserve tanks for Y (yellow), M (magenta), and C (cyan) into which the developers in the Y (yellow), M (magenta), and C (cyan) cartridges flow respectively;

wherein the reserve tank for K (black) has a larger capacity than the Y(yellow), M(magenta), or C(cyan) reserve tanks.

12. An image formation apparatus comprising:

a developing unit for developing latent image;

a first reserve tank that temporarily stores developer ejected from a first cartridge and a second cartridge and that discharges the developer to the developing unit;

a storage amount sensor for sensing storage amount of the developer in the first reserve tank; and a controller for controlling ejection of developer from at least the first cartridge and the second cartridge into the first reserve tank in accordance with output from the storage amount sensor.

13. The image formation apparatus as claimed in claim 12, further comprising:

a second reserve tank that temporarily stores developer ejected from a third cartridge and that discharges the developer to the developing unit;

wherein the second reserve tank is smaller than the first reserve tank in storage capacity of developer.

14. The image formation apparatus as claimed in claim 13, wherein the first reserve tank is used for storing K (black) developer.

15. The image formation apparatus as claimed in claim 13, wherein the second reserve tank is used for storing developer of a predetermined color other than K (black).

* * * * *